United States Patent [19]

Porter, Jr.

[11] 4,142,345

[45] Mar. 6, 1979

[54] NESTABLE CONTAINER PACKAGING APPARATUS

[75] Inventor: Harold Porter, Jr., Setauket, N.Y.

[73] Assignee: Owens-Illinois, Inc., Toledo, Ohio

[21] Appl. No.: 821,013

[22] Filed: Aug. 1, 1977

[51] Int. Cl.[2] ..... B65B 57/20; B65B 35/44

[52] U.S. Cl. ..... 53/54; 53/542; 53/202; 53/500; 198/462; 198/503; 414/30

[58] Field of Search ..... 53/54, 62, 78, 159, 53/202; 198/418, 423, 431, 462, 503; 214/7

[56] References Cited

U.S. PATENT DOCUMENTS

| | | | |
|---|---|---|---|
| 1,351,018 | 8/1920 | Blando | 198/462 |
| 2,936,557 | 5/1960 | Fay | 53/202 |
| 3,187,878 | 6/1965 | Harrison et al. | 198/461 |
| 3,436,895 | 4/1969 | Dearne et al. | 53/54 |
| 3,620,386 | 11/1971 | Bivans et al. | 217/7 |
| 3,665,674 | 5/1972 | Bivans et al. | 53/202 |
| 3,870,139 | 3/1975 | Wagner | 198/423 |
| 4,066,174 | 1/1978 | Collins et al. | 217/7 |

*Primary Examiner*—Robert Louis Spruill
*Attorney, Agent, or Firm*—M. E. Click; H. F. Mensing

[57] ABSTRACT

A cup packaging device for seriately receiving, counting and loosely nesting into a group on a first conveyor segment a preset number of cups, nesting the cups into a more tightly nested stack on a subsequent conveyor segment, conveying the tightly nested group of cups at an accelerated speed past a verifying device to determine if the number of cups in the group matches the previously counted number, laterally offloading to a holding tray a stack of cups in response to a count mismatch signal or a downstream component malfunction signal, advancing an acceptable stack into a bagging device, conveying the bagged stack longitudinally out of the bagging device and then transferring the stack laterally into a collection bin. The conveyor system comprises separately driven conveyor segments which are operated at speeds that vary from one another and are also changed during each cycle.

18 Claims, 34 Drawing Figures

FIG. 15
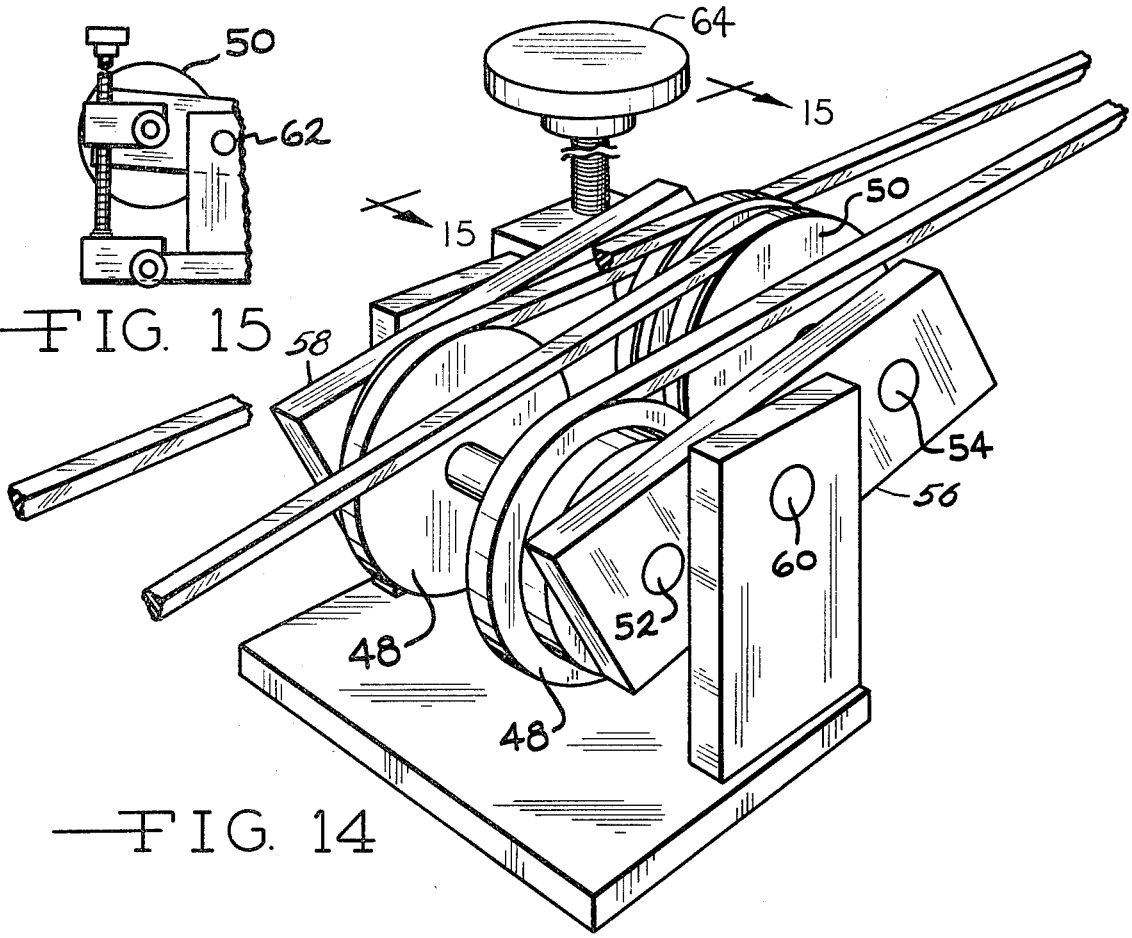
FIG. 14
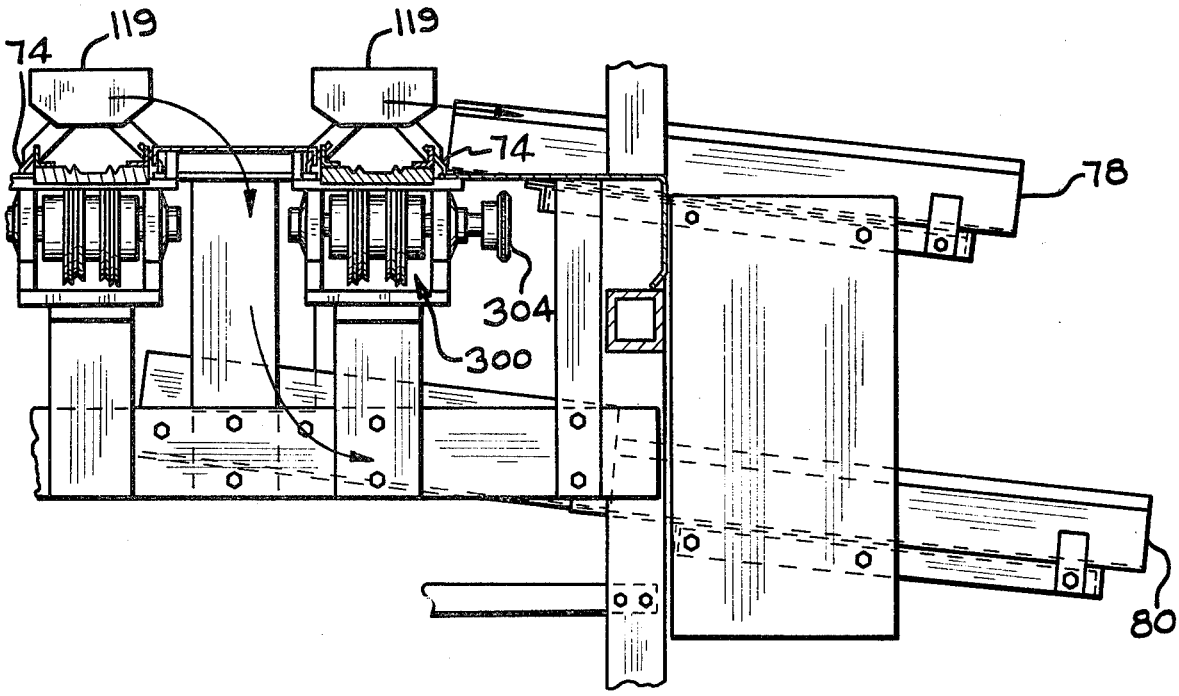
FIG. 16

NESTABLE CONTAINER PACKAGING APPARATUS

BACKGROUND OF THE INVENTION

Numerous attempts have been made to automatically collect nestable cups into groups or stacks of equal numbers as they come off manufacturing lines. One of the greatest problems encountered was getting succeeding cups to reliably telescope into or onto the end of the preceding cup. Usually the devices involved a conveyor having a support belt under the stack of cups and a retention belt which extended over the top of the stack of cups and contacted the underlying portions of the cup rims. Since the cups were confined between the overlying and underlying belts, the conveyor was difficult to clear in the event of jams or other malfunctions.

The present invention provides conveying and nesting means which do not require the use of an overlying belt. As a result the top of the applicant's conveying and nesting system is open, thus giving an operator free access to the nested cups. Reliable nesting is achieved by a combination of means, including a plurality of conveyor segments comprising interjoined pairs of belts driven by a drive train that allows the separate segments to be operated at different speeds simultaneously.

SUMMARY OF THE INVENTION

Generally speaking, the cup packaging device comprises a conveyor system for seriately receiving cups directly from a manufacturing line, counting the cups, nesting them together, advancing a group or stack of cups past a verifier after the counter has reached a preset number, offloading to holding trays any stack having a number of cups that does not match the preset number, longitudinally advancing stacks of cups having the correct number to a lateral transfer mechanism, transferring the stacks to an adjacent parallel conveyor which, in turn, conveys the stacks one at a time into and through a bagging device and ultimately offloads the separately packaged stacks of cups into a collection bin.

Basically, each conveyor segment comprises a pair of continuous belts having top runs which are spaced apart and converge slightly or are parallel. The trailing ends of the belts of one segment extend beyond the leading ends of the succeeding belt thus interjoining the segments. A primary feature of the invention resides in the arrangement of the conveyor components in the nesting area wherein the top runs of each pair of belts converge in a downstream direction. At the junction between the nesting conveyor segment and the infeed conveyor segment located immediately upstream, the downstream end of the infeed segment converges and enters between the upstream ends of the nesting segment. Preferably, these belt ends are interjoined by means of an adjustable rocker arm assembly whereby the relative height and inclination of these adjoining ends may be adjusted to enhance nesting. Nesting is further enhanced by controlling the relative speeds of the infeed and nesting belt conveyor segments so that successive cups on the nesting segment are not tightly telescoped or nested together but are only loosely inserted into one another. The cups at the leading end of a stack or series of loosely nested cups may be tighly nested together as they progress onto a subsequent conveyor segment by driving it at a slower speed than the loose-nesting conveyor segment.

When the counter indicates the preset count has been reached, the conveyor segments carrying the group of cups are accelerated so as to quickly convey the completed group to the next conveyor segments. In doing so, the cup rims intercept a light beam of a verifying counter. If the verified count does not match the preset count, a reject signal activates an offloading mechanism whereby the unacceptable stack of cups is dumped into a holding tray. Stacks of cups having the proper number of cups therein are conveyed in a longitudinal direction to a lateral transfer mechanism which transfers them to an adjacent parallel conveyor leading into an encapulating or bagging device that seals the stack of cups in a plastic overwrap. After this step is completed, the packaged stack of cups is conveyed away from the bagger and transferred to a collection bin. At intervals an operator who may attend two or more of such machines removes the stacks of cups which have accumulated in the bin and packs them in boxes.

BRIEF DESCRIPTION OF THE DRAWINGS

FIG. 14 is an enlarged perspective view of the adjustable rocker arm assembly for setting the step height between the infeed belt and the nesting belt conveyor segments.

FIG. 15 is an elevational view of reduced size taken along lines 15—15 of FIG. 14 showing the adjusting mechanism.

FIG. 16 is an enlarged sectional view taken along lines 16—16 of FIG. 1 showing the offloading trays.

DETAILED DESCRIPTION OF THE INVENTION

Conveyor System

Figure 2:
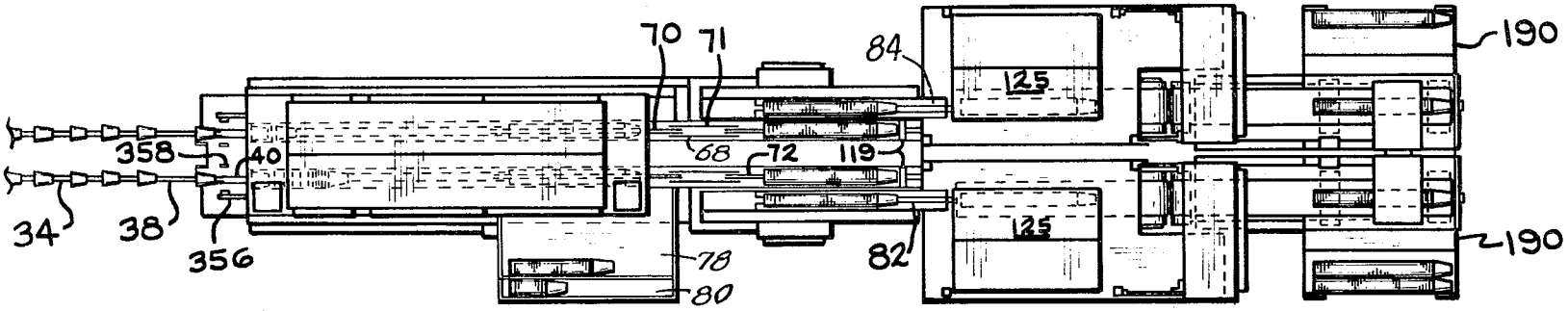
FIG. 2 is a plan view of the apparatus of FIG. 1 showing the dual lane conveyor system.
Figure 1:
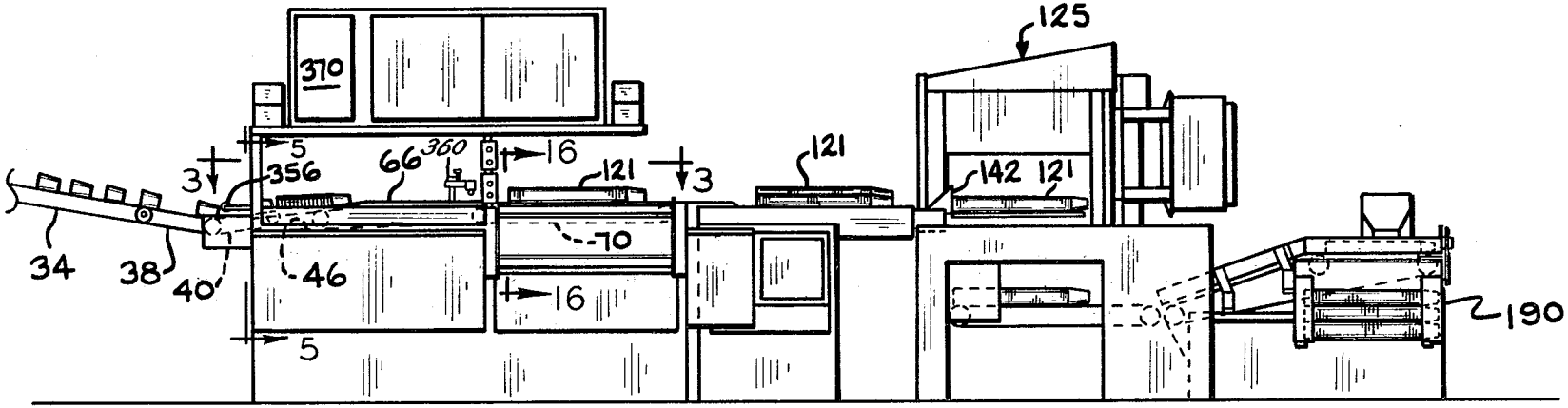
FIG. 1 is an elevated view of a preferred embodiment of the cup packaging apparatus.
Figure 3:
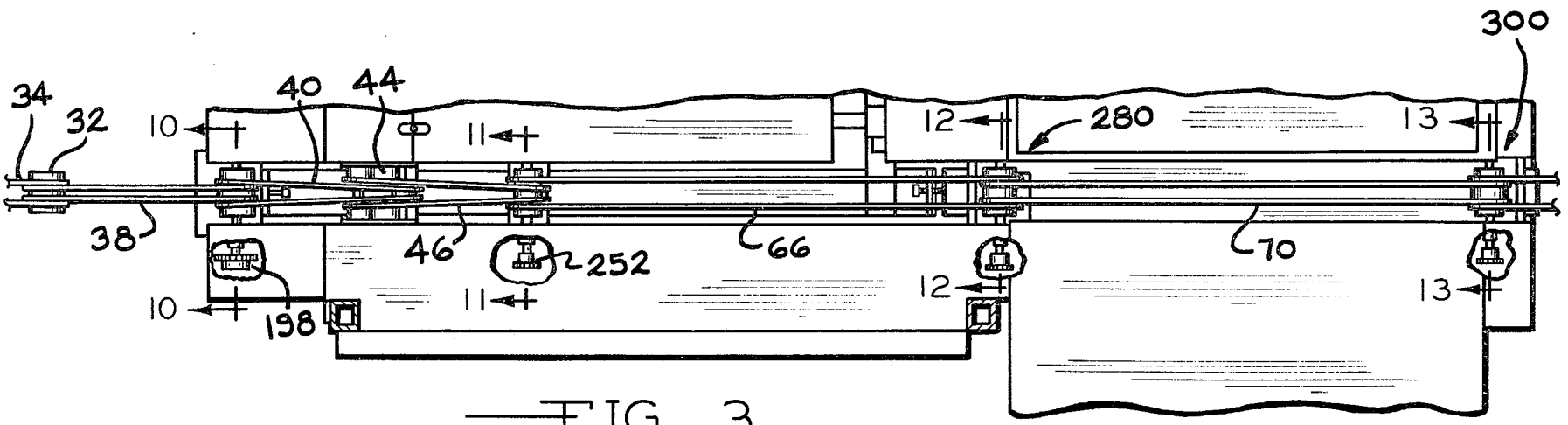
FIG. 3 is an enlarged plan view of the forward end of the right hand lane of the dual conveyor system taken along lines 3—3 of FIG. 1 with parts broken away.

The preferred embodiment illustrated in the drawings has a dual-lane conveyor system capable of receiving two separate supply streams of cups direcely from production equipment, for example, directly from a dual-lane waxing oven. Each of the dual lanes has substantially the same structural components as the other but with the components of one lane being disposed in a mirror image relationship to the corresponding parts of the other lane in most instances. So, for the sake of brevity, only the structural features of one lane will be described in detail except where a full description of both lanes is necessary for a complete understanding of the invention. Also it is to be understood that many of the teachings of this invention apply to single-lane conveyor systems and thus the scope of this disclosure is not intended to be limited to the illustrated two-lane embodiment.

Referring to the drawings beginning with FIGS. 1–4 wherein the overall arrangement of the components of the packaging machine 30 are shown, the nestable cups are received by the conveyor end at the left side of the drawings and are conveyed towards the right side. The broken-away conveyor section extending upstream from the first sheave assembly 32 is the supply conveyor 34 which carries the cups from a production line source or other source to the infeed conveyor segment 36 of the packaging machine. Generally, the cups arrive at the infeed conveyor bottom first and spaced from each other, but it is possible to adjust the relative heights and angles of inclination of the conveyor segments so that cups travelling in a top first orientation may be nested.

The infeed conveyor segment 36 is comprised of two sections 38 and 40 connected together by a common drive assembly 42. The first section 38 extends downwardly from the supply conveyor segment 34 to the infeed drive sheave assembly 42, while the second section 40 is inclined upwardly from the infeed drive sheave assembly 42 to an idler sheave assembly 44 where it interconnects with the succeeding nesting conveyor segment 46. Preferably, each conveyor section is of the twin continuous belt type which cradles the cups between the top runs of the belts. In some instances, the top runs of the twin belts converge slightly in the downstream direction in the form of a slender wedge. For example, each of the converging belts may be at an angle of 8°–12° with respect to the conveyor centerline. Preferably, the second infeed section 40 and the nesting segment 46 have converging top runs that are interconnected so their narrow ends are inserted between and overlap the wider ends of their respective succeeding sections as can be readily seen in FIG. 3. The twin belts of the first infeed section 38 and the other remaining conveyor segments may have parallel top runs. The spacing between each parallel set of belts is selected so the belt ends of one set either fit on the inside or the outside of the overlapping ends of an adjoining set. Generally, sufficient overlapping of the belt ends is achieved by mounting the sheaves for both pairs of adjoining belt ends on a common shaft as shown in FIGS. 10–13. One noticeable variance from this is the idler assembly 44 located at the junction of the second infeed section 40 and the nesting segment 46 where the pairs of sheaves 48, 50 are mounted on separate shafts 52, 54 at opposite ends of a pair of rocker arms 56, 58 (see FIG. 14). The pair of larger diameter sheaves 48 for the nesting conveyor segment 46 is rotatably mounted on the shaft 52 at the upstream end of the idler assembly 44, whereas the smaller diameter pair of sheaves 50 for the belt ends of the second infeed section 40 is rotatably mounted on the shaft 54 located at the downstream end of the idler assembly. Axle pins 60, 62 located in the center of the rocking arms support the idler assembly so that as one end is raised, the other is lowered. An adjusting mechanism, including a thumb screw 64 attached between one end of the idler assembly and a machine frame member, is provided for manually changing the relative level and angle of inclination of the adjacent ends of the conveyor segments so as to optimize the nesting of cups as they arrive on the nesting conveyor segment from the infeed conveyor segment. The angles of inclination of the second infeed section and the nesting conveyor segment with respect to a horizontal line are both approximately 8°–10° with the nesting conveyor segment being about 1°–3° greater than the adjoining infeed section. The offset or step between the belt ends may range between one-fourth and one-half inch with the infeed belts being above the nesting belts by this amount for nesting cups travelling on the conveyor in a bottom first orientation.

The conveyor segment immediately downstream from the nesting segment 46 is designated as the verification segment 66. This, in turn, is followed by a conveyor segment designated as the delivery segment 68 comprised of three aligned conveyor sections, namely, a first section 70, an intermediate section 71 and an end section 72. The first and end sections have lengths equal to or in excess of the maximum length of a stack of cups. All of these conveyor segments or sections are of a twin-belt type with parallel top runs and overlapping ends. The belts of the verification segment 66 are spaced apart more than the belts of the first delivery section 70 and lie outside of the belts of the first delivery section. The intermediate and end sections of the delivery segment have wide and narrow spacing relatively.

Figures 23, 24, 24A:
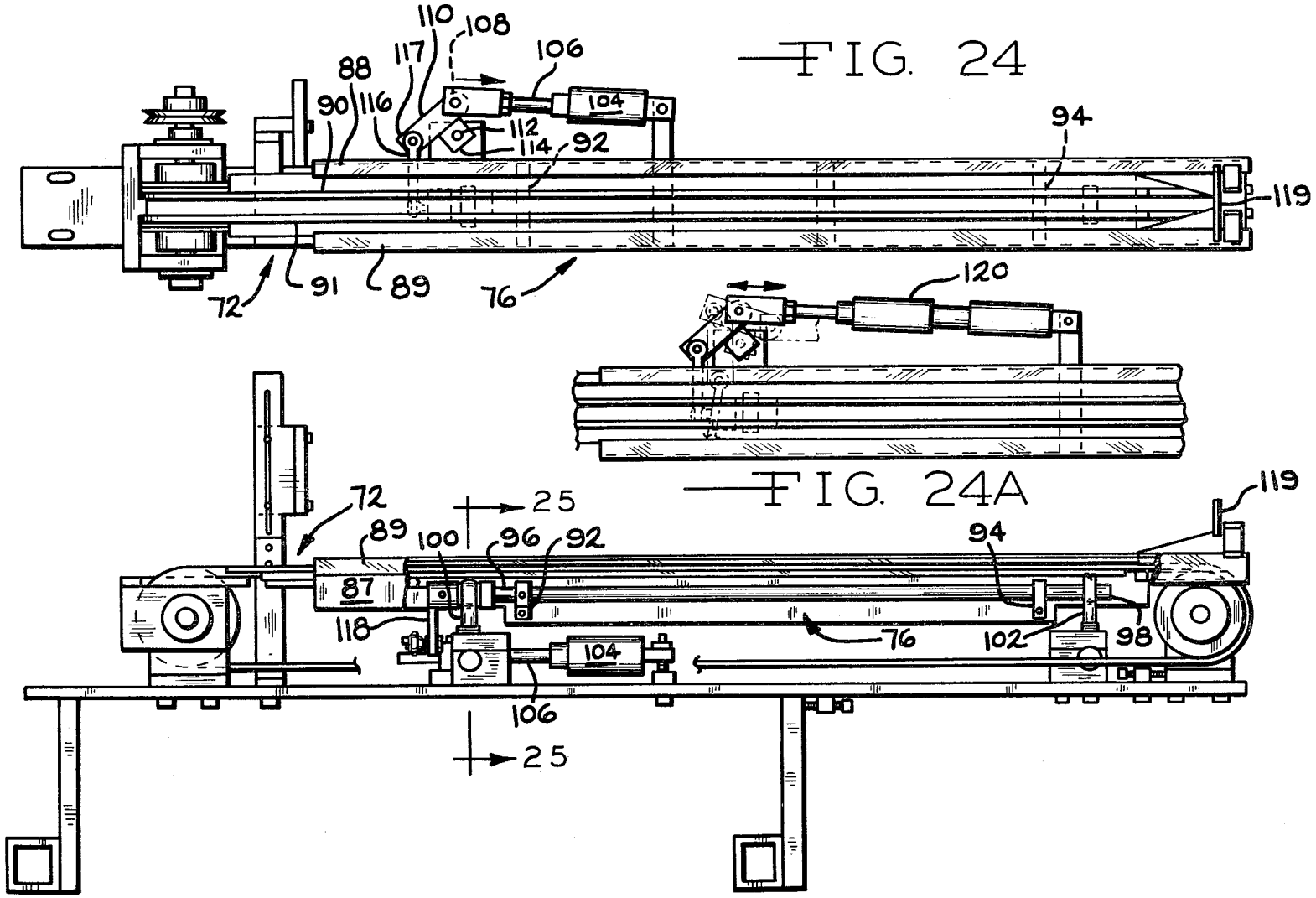
FIG. 23 is an enlarged elevational view of the offloading mechanism with parts broken away.
FIG. 24 is a plan view of the offloading mechanism of FIG. 23.
FIG. 24A is a plan view of an offloading mechanism actuator which provides for selectively offloading stacks of cups to either side of the conveyor.
Figure 25:
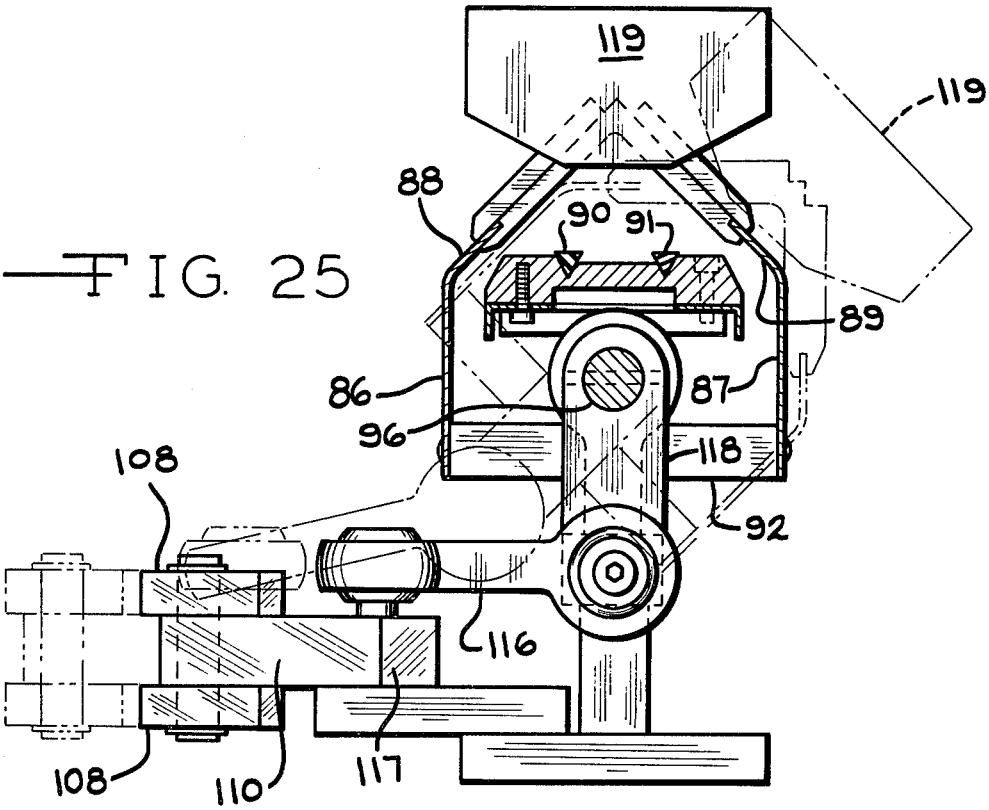
FIG. 25 is an enlarged sectional view taken along lines 25—25 of FIG. 23 showing the normal position of the offloading mechanism in full lines and the offloading position in phantom lines.

An offloading device 74 is associated with the narrow first delivery section 70 and a structurally similar lateral transfer device 76 is associated with the narrow end delivery section 72. Both devices 74 and 76 cause a stack of cups to be displaced from their respective conveyor sections, but the offloading device merely allows the stack to fall into a holding tray 78 or 80 (see FIG. 16), while the lateral transfer devices cause a stack of cups to fall onto an adjacent parallel conveyor denoted as the bagger infeed conveyor 82 or 84 (see FIGS. 2, 18). Due to the structural similarity of the two devices, only the lateral transfer device 76 will be described in detail. Referring to FIGS. 23–25, the illustrated transfer device 76 comprises an elongated open trough having vertical side walls 86, 87 with angularly inturned upper panels 88, 89 that extend along practically the entire length of the conveyor section 72 with their top edges disposed slightly above and to the outside of the parallel twin belts 90, 91. The side walls are held in their opposed spaced-apart parallel relationship by means of two lateral cross braces 92, 94 located intermediate the trough ends and affixed to the lower edges of the side walls 86, 87. Coaxial pivot pins 96, 98 affixed to the centers of the cross braces are journalled in bearing blocks 100, 102 mounted on the machine frame so that the trough is free to pivot on an axis extending beneath the center line of the twin belts 90, 91 and parallel therewith. A tilting mechanism is provided to rotate the trough approximately 45° about its axis and bump a stack of cups laterally from the conveyor in response to a signal. In the embodiment illustrated in FIGS. 23 and 24, the tilting mechanism comprises a single pneumatic cylinder 104 with an actuator rod 106 connected to one end 108 of the head of a T-shaped crank level 110 which is pivoted about a fixed pin 112 through the central leg 114 of the lever 110. A rod 116 is pivotally connected between the other end 117 of the head of the lever and lower end of a depending arm 118 affixed to one of the pivot pins 96. When the trough is in its normal nontilted position, the actuator rod 106 is in a fully extended position. To tilt the trough the pneumatic cylinder 104 retracts the actuator rod causing the crank lever 110 to rotate in a clockwise direction, which in turn causes the connecting rod 116 to rotate the depending arm 118 in a clockwise direction, thus tilting the trough to the phantom line position shown in FIG. 25. The principal difference between the offloading mechanism 74 and the lateral transfer mechanism is the latter has an abutment block 119 for stopping the travel of a stack of cups on the end section 72 of the delivery conveyor alongside the bagger infeed conveyor 82.

Figure 28:
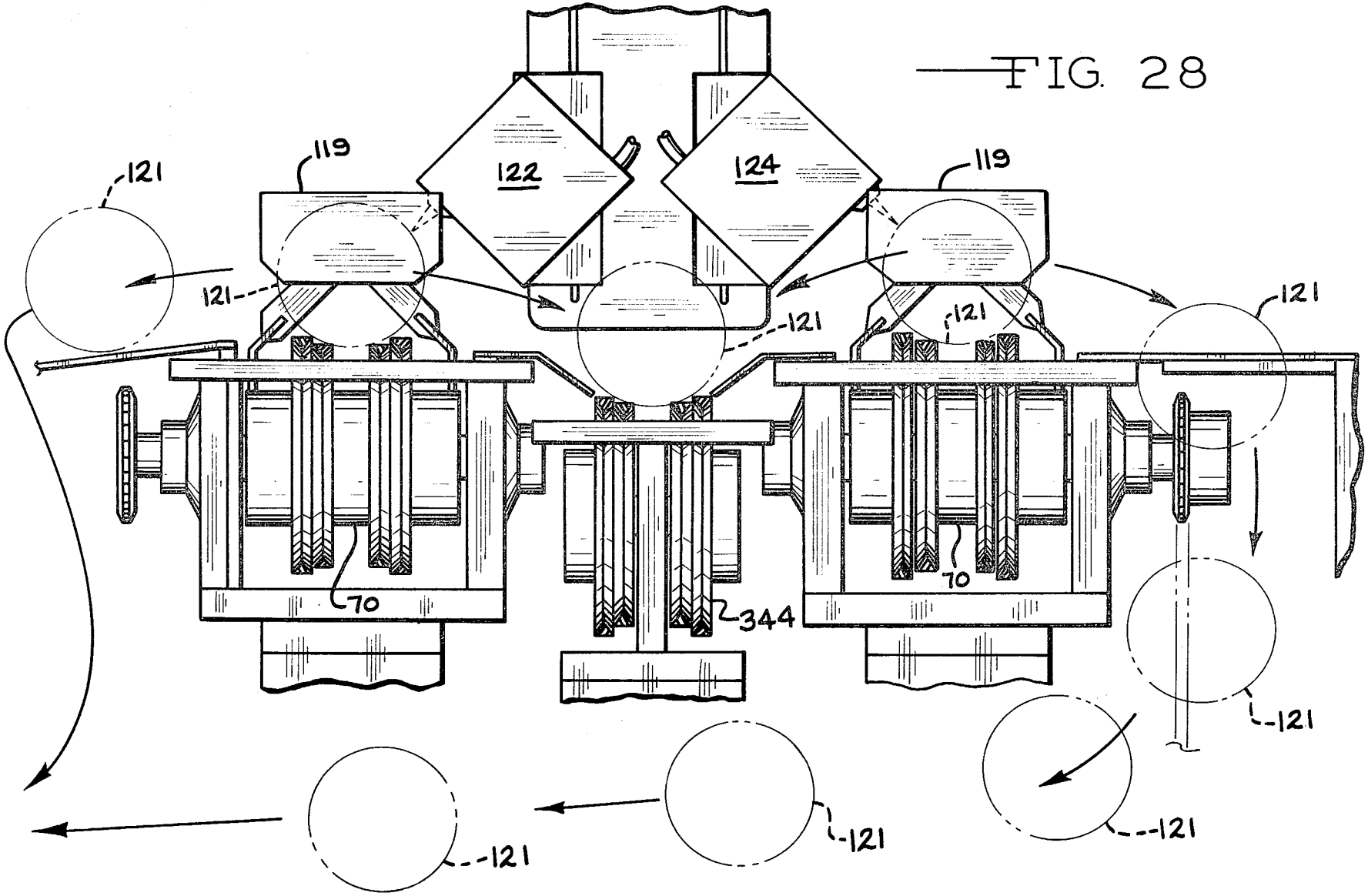
FIG. 28 is an enlarged sectional view illustrating the offloading section of a conveyor employing the double actuator of FIG. 24A to merge a dual lane conveyor into a single center lane leading to a single bagging device.

By providing a double-acting pneumatic cylinder means 120, as shown in FIG. 24A, the trough may be tilted to either side of center so that a stack of cups can be selectively displaced to one side or the other of the conveyor. The actuator rod on one end of the pneumatic cylinder means 120 is normally in a fully extended position while the actuator rod at the other end of it is fully retracted. Extending the normally retracted rod tilts the trough to one side and retracting the normally extended rod tilts it to the other side. This embodiment is used on a packaging machine having a dual-lane counting and verifying section that is merged into a single lane prior to entry into a single bagging device, as shown in FIG. 28. Stacks of cups 121 on either of the dual lanes may be offloaded to the outside in the event of a verification count mismatch or when the lane scanners 122, 124 signal that the opposite lane already has an entering stack of cups thereon.

The bagger infeed conveyor segment 82 receives a stack of cups from the lateral transfer mechanism 76 and longitudinally conveys the stack directly into a bagging device 125 such as a DOBOY manufactured by Doughboy Industries, Inc., wherein the stack is sealed in a plastic overwrap. The bagger infeed 82 has twin continuous belts 126, 127 supported in a parallel relationship at opposite ends by pairs of sheaves 128, 130. The upper runs of the belts 126, 127 are at a lower level than the upper runs of the end delivery conveyor section 72 as can be seen most clearly in FIG. 18. A guideway, including an inclined ramp 136 extending between the upper and lower conveyors and an upright curb 138 extending along the far side of the lower conveyor, is provided to assist in the transfer of a stack of cups from one conveyor to the other and to retain the stack on the lower conveyor.

Figure 19:
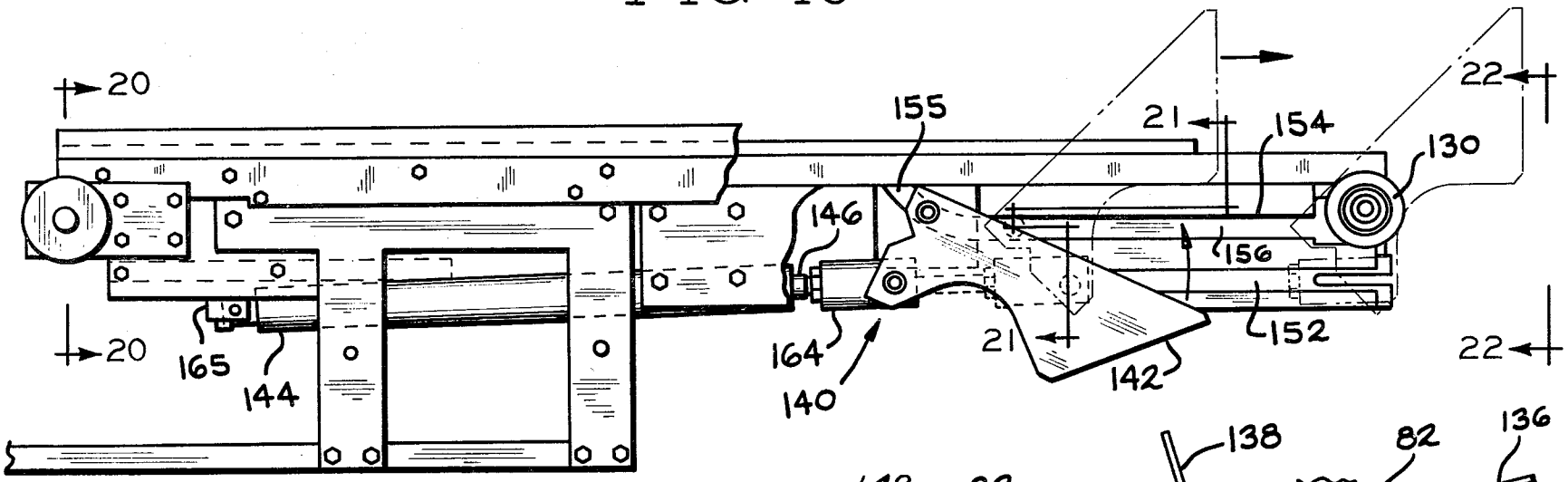
FIG. 19 is a further enlarged view of the bagger infeed conveyor segment of FIG. 17 with parts broken away to show the details of the bagger infeed positioning ram.
Figure 22:
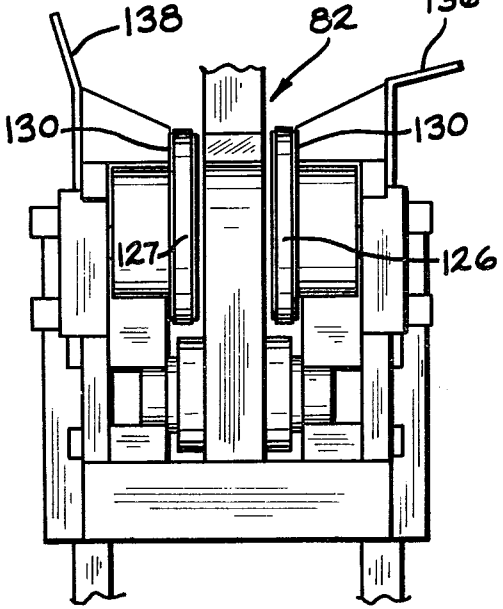
FIG. 22 is an enlarged sectional view taken along lines 22—22 of FIG. 19.
Figure 21:
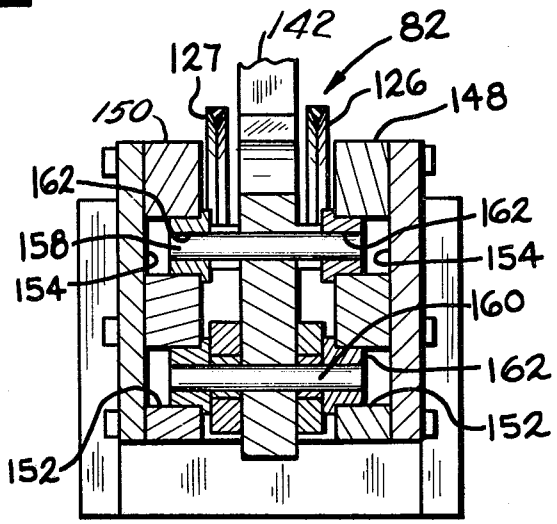
FIG. 21 is an enlarged sectional view taken along lines 21—21 of FIG. 19.
Figure 20:
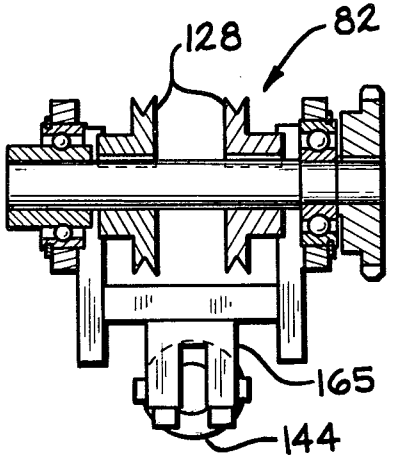
FIG. 20 is an enlarged sectional view taken along lines 20—20 of FIG. 19.

Preferably a positioning device is provided at the downstream end of the bagger infeed conveyor 82 so that a stack of cups can be precisely positioned lengthwise in the bagging device 125. The positioning device 140 may include a rectractable ram 142 which in its retracted position lies between belts 126, 127 below their top runs. It is reciprocated to an upright position above the top runs and then moved towards the bagging device 125 by means of a double-acting pneumatic cylinder 144 and piston rod 146. This is accomplished by symmetrical pairs of cam tracks machined in supporting side plates 148, 150 mounted on opposite sides of the ram 142. The lower track 152 of each pair is straight and horizontal whereas the upper cam track 154 is curved 155 from a higher level at its upstream end to a horizontal level 156 slightly above the downstream end of the lower track 152 as shown in FIG. 19. A pair of spaced-apart roller pins 158, 160 are located in the base of the ram and have cam rollers 162 rotatably mounted on their ends which extend outwardly beyond the sides of the ram (see FIG. 21). A clevis 164 at the end of the piston rod 146 is connected to the lower or forward roller pin 160. The opposite end of the pneumatic cylinder 144 is anchored to a bracket 165 affixed to the machine frame (see FIG. 20). When the piston rod 146 is fully retracted, the ram 142 is in its rearward position tilted downwardly below the top runs of the infeed conveyor belts as shown in full lines in FIG. 19. As the piston rod is extended, the ram moves forward and causes the top or rearward cam pin 158 and rollers to travel downwardly and forwardly along the curved portion 155 of the cam track 154 into the horizontal section 156, thus tilting the ram 142 to an upright position as shown in phantom lines. Continued extension of the piston rod 146 moves the ram along the horizontal track sections to its maximum downstream position as shown in phantom lines to the right of the first phantom line position.

Activation of the pneumatic cylinder 144 is controlled by a bistable valve 170 which is electrically energized to a first position, thus directing air under pressure to flow into the fixed end of the cylinder causing the piston rod 146 to advance to a fully extended position. The valve 170 is mechanically tripped to its alternate or second position which directs air under pressure to flow into the opposite end of the cylinder causing the piston rod to be retracted. The maximum travel of the ram may be precisely set by adjusting the relative position of the trip mechanism 172 (see FIG. 17).

The trip mechanism 172 comprises a mounting plate 174 adjustably fixed to the conveyor frame adjacent its downstream end by means of bolts and elongated slots 176. A reciprocable rod 178 carrying a ramp type cam 180 is slidably bracketed on the plate 174. It is biased to its upstream position by a concentric compression spring 182 contracted between a bracket 184 and a collar 186. The downstream end of the rod 178 is bent at a 90° angle and extends across the path of the ram 142 so that as the ram approaches its fully extended position, it comes into contact with the rod 178 and pushes the rod in an upstream direction causing the cam 180 to engage a pivotal trigger member 188 which, in turn, mechanically trips the pneumatic valve 170 to its above-mentioned second position, thereby returning the ram to its retracted position out of the path of the next stack of cups to be transferred to the bagger infeed belts.

After a stack of cups is properly positioned in the bagging device 125 by the ram 142, a heat sealing means forms a sealed bag around the stack of cups from two sheets of thermoplastic film. In the process, the encapsulated or bagged stack of cups descends to the bottom of the bagging device from whence it is conveyed upwardly to a ledge where it is laterally offloaded into the collection bin 190 for holding a plurality of bagged stacks awaiting removal by the machine operator at his convenience.

DRIVE SYSTEM

In describing the drive system, only one lane, i.e., the right lane of the dual lane conveyor system embodiment, will be explained in detail and, for the sake of description, the right side of that lane is on the right of a viewer looking in the direction of conveyor travel. Referring to FIGS. 3–13 of the drawings, the conveyor system main drive begins with a constant speed electric motor and gear reduction unit 192 having an output shaft 194 which extends horizontally from both sides and turns at a constant speed of 116 RPM. An 18-tooth sprocket 196 affixed to the right-hand end of the output shaft is directly connected by a chain 197 to another 18-tooth sprocket 198 on the infeed conveyor segment drive shaft 199. An inner pair of belt sheaves 200 and an outer pair of belt sheaves 202 are both affixed to the drive shaft 199 and the inner pair of sheaves has a slightly smaller diameter than that of the outer pair of sheaves, for example 5–10% less. Thus the upstream section 38 of the infeed conveyor driven by these inner sheaves 200 has a correspondingly slower belt speed than the downstream section 40 driven by the outer pair of sheaves 202.

A 20-tooth 204 sprocket on the opposite or left-hand end of the output shaft 194 is connected by a drive chain 206 to a 45-tooth sprocket 208 affixed to the input shaft 209 of a speed reducer 210 having an 8.85:1 reduction. The output shaft 209 of this reducer drives a series of three spur gears 213, 214, 215, the first two of which are changeable gears selected from a group of gear sizes ranging from 24–60 tooth gears for driving the third gear which has 60 teeth. The last gear 215 of this series is keyed to a shaft designated the slow speed transmission shaft 216. The slow speed shaft is in turn affixed to the driving side of a magnetic clutch 218. Two 32-tooth sprockets 220, 222 located on the driven side of the clutch are carried on a freely rotatable tubular shaft 223 concentrically mounted on shaft 216. The sprockets 220, 222 are coupled to the tubular shaft 223 by means of roller ramp-type mechanical clutches 224, 226 (see FIG. 8). One of the sprockets 222 is connected by a chain 228 to a 32-tooth sprocket 230 affixed to the nesting conveyor segment transmission shaft 232, while the other sprocket 220 is likewise connected by a chain 234 to a 65-tooth sprocket 236 affixed to the verification conveyor segment transmission shaft 240. When the magnetic clutch 218 is engaged, it turns the tubular shaft 223 in a direction that causes the two roller ramp clutches 224, 226 to become engaged and turn their respective sprockets 220, 222, thus driving the nesting and verification conveyor segment shafts 232, 240 in the slow speed mode.

Figure 8C:
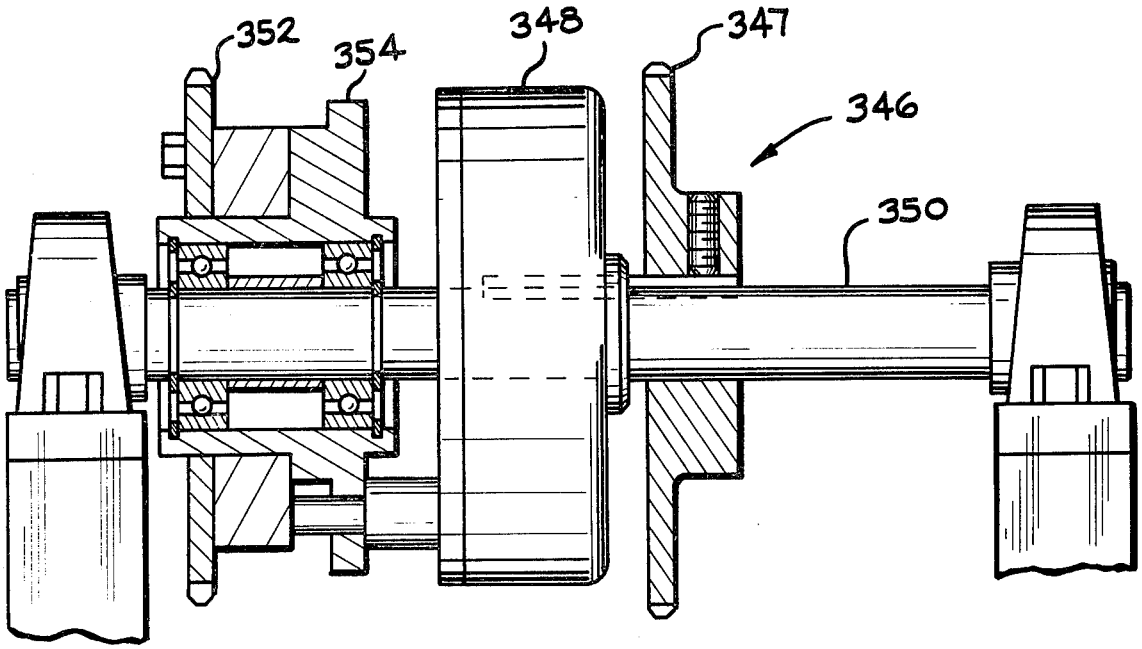
FIG. 8C is an enlarged partially sectioned view taken along lines 8C—8C of FIG. 7 showing the details of an additional transmission shaft assembly illustrated in phantom lines in FIG. 7 and used with a second embodiment.
Figure 8:
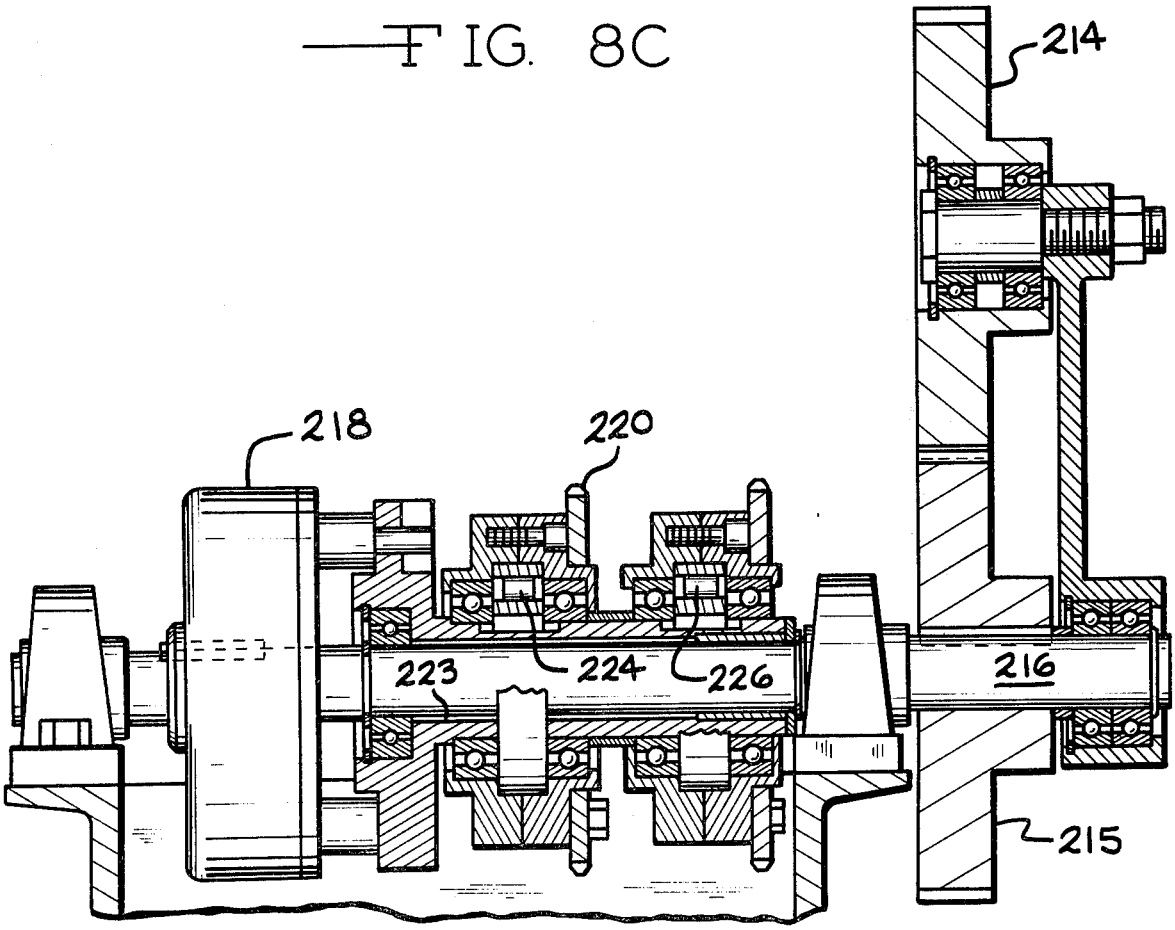
Figure 8B:
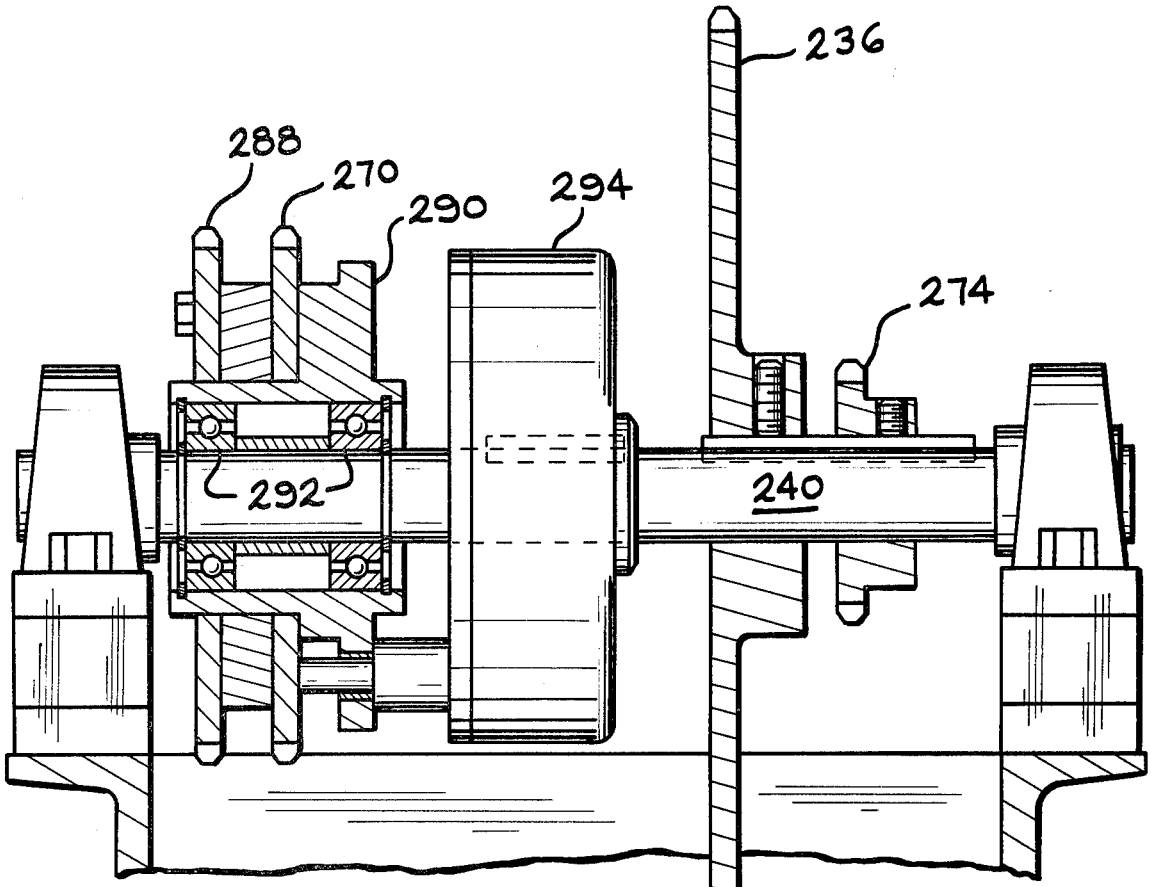
Figure 8A:
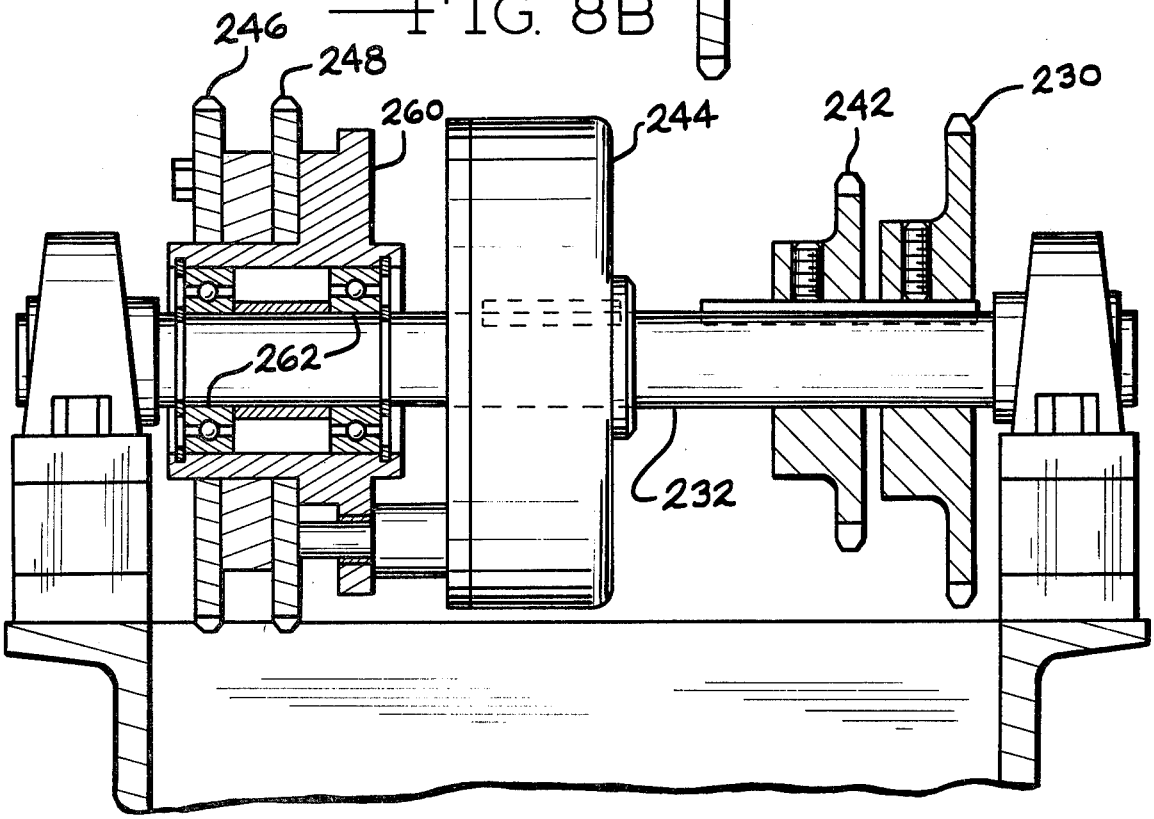
Figure 12:
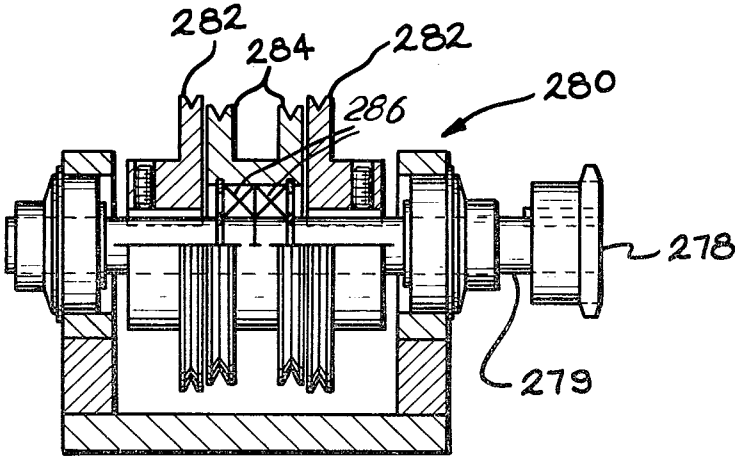
FIGS. 10-13 are enlarged partially sectional views taken along lines 10—10, 11—11, 12—12 and 13—13 of FIG. 3 showing the respective sheave assemblies in detail.
Figure 10:
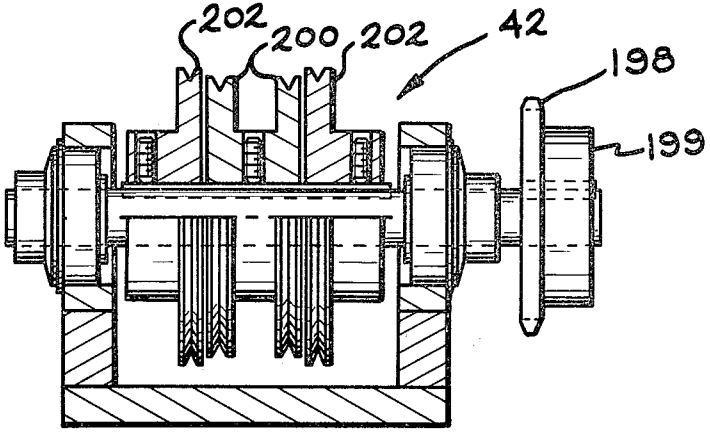
Figure 11:
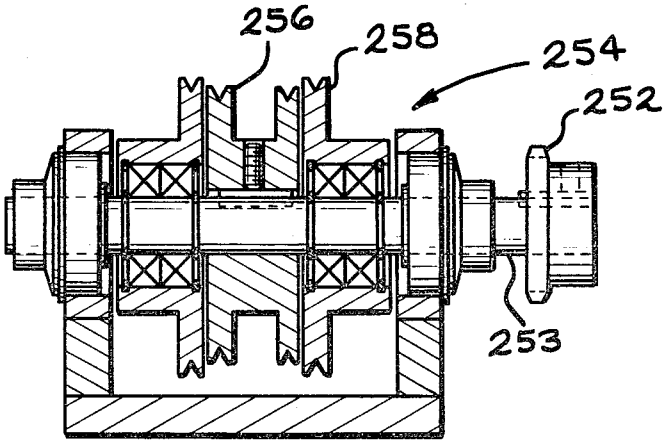
Figure 13:
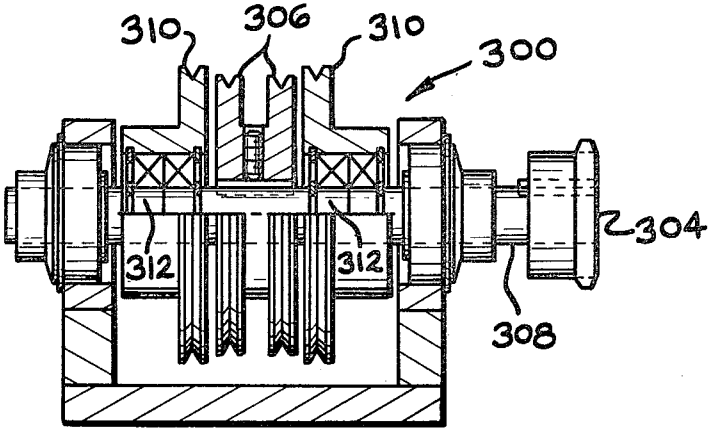

The nesting conveyor transmission shaft 232 carries a 24-tooth sprocket 242, a magnetic clutch 244 and a pair of 35-tooth sprockets 246, 248 in addition to the aforementioned 32-tooth sprocket 230 (see FIG. 8A). The 32-tooth sprocket 230 is keyed to the nesting transmission shaft 232 and serves as the drive sprocket for the shaft when the shaft is being driven in the slow speed mode. The 24-tooth sprocket 242 is also keyed to the shaft but functions as a driven sprocket connected by a chain 250 to the 12-tooth sprocket 252 keyed to the shaft 253 of the nesting belt drive assembly 254. An inner pair of sheaves 256 are keyed to the shaft 253 and drive the nesting conveyor segment 46 belts extending in an upstream direction to the idler assembly 44 (see FIG. 11). An outer pair of sheaves 258 are rotatably mounted on the shaft and serve as idler sheaves for the verification conveyor segment 66 belts extending in a downstream direction. The 35-tooth sprockets 246, 248 are both affixed to a freely rotatable hub 260 member mounted on the transmission shaft 232 by means of bearings 262. The hub member 260 is rotated by the driven side of the nesting clutch 244. When the conveyor system is cycling through the slow-speed mode, the nesting clutch 244 is disengaged and the nesting transmission shaft 232 is being driven by the 32-tooth sprocket 230 coupled by drive chain 228 to the corresponding 32-tooth sprocket 222 of the slow-speed transmission shaft 216. When the fast-speed portion of the cycle is reached, the nesting clutch 244 is engaged and the driven shaft 232 is then rotated at a higher speed than before, thus causing the roller cam clutch 226 for the interconnected 32-tooth sprocket on the slow-speed shaft to be overridden and disengaged. The driving side of the nesting clutch 244 is driven at the higher rotational speed by means of a drive chain 264 extending from the left or inside sprocket 246 of the pair of 35-tooth sprockets to a 30-tooth sprocket 266 keyed to the output shaft 194 of the gearmotor unit 192. The rotational speed changes from a nominal speed of about 2.5–6 RPM in the slow mode to 100 RPM in the fast mode. The other 35-tooth sprocket 248 of the pair is connected by a drive chain 268 to a 35-tooth sprocket 270 of the verification transmission shaft assembly.

The verification transmission shaft assembly shown in FIG. 8B is structurally the same as the nesting or fast-speed transmission shaft assembly shown in FIG. 8A with the notable difference being in the size of the sprockets affixed to the transmission shaft 240. The smaller sprocket 274 affixed to shaft 240 is a 16-tooth sprocket connected by a chain 276 to the sprocket 278 keyed to shaft 279 of the verification belt drive shaft assembly 280. An outer pair of belt drive sheaves 282 are keyed to the shaft 279 and drives the twin belts of the verification conveyor 66 extending in an upstream direction from the shaft assembly (see FIGS. 4 and 12). An inner pair of sheaves 284 are rotatably mounted on the shaft 279 by means of bearings 286. The pair of sheaves 284 serves as the idler for the first section 70 of the delivery conveyor segment 68. The larger sprocket 236 affixed to the verification drive transmission shaft 240 is a 64-tooth sprocket connected by chain 234 to the roller ramp clutch mounted sprocket 220 of the slow-speed transmission assembly as previously described.

The aforementioned 35-tooth sprocket 270 and another 35-tooth sprocket 288 are paired together and affixed to a hub member 290 which is rotatably mounted on transmission shaft 240 by bearings 292. A clutch 294 affixed to shaft 240 is provided to engage hub member 290 and rotate shaft 240 in the high-speed mode via sprocket 270, chain 268 and sprocket 248. When clutch 294 is disengaged from hub member 290, the shaft may be rotated in its slow-speed mode via sprocket 236, chain 234 and sprocket 220. Driven sprocket 288 is connected by a chain 296 to the 32-tooth side 297 of a speed reducer sprocket 298 located directly below the delivery belt drive shaft assembly 300 for the first section 70 of the delivery conveyor segment 68. A 12-tooth sprocket 302 affixed to the 32-tooth sprocket 297 is coupled by a drive chain 303 to another 12-tooth sprocket 304 on the delivery belt drive shaft assembly 300. An inner pair of sheaves 306 of shaft assembly 300 are keyed to the drive shaft 308 so as to drive the delivery belts extending upstream therefrom (see FIG. 13). Thus the delivery belt drive train for the first section of the delivery conveyor has positively driven components extending back to the 30-tooth sprocket 266 on the left side output shaft of the gear motor unit 192 so that the first delivery belts run continuously at a constant speed. An outer pair of sheaves 310 of shaft assembly 300 carry the upstream end of the intermediate delivery belt section 71 and are rotatably mounted by bearings 312 on shaft 308.

Figures 17, 18:
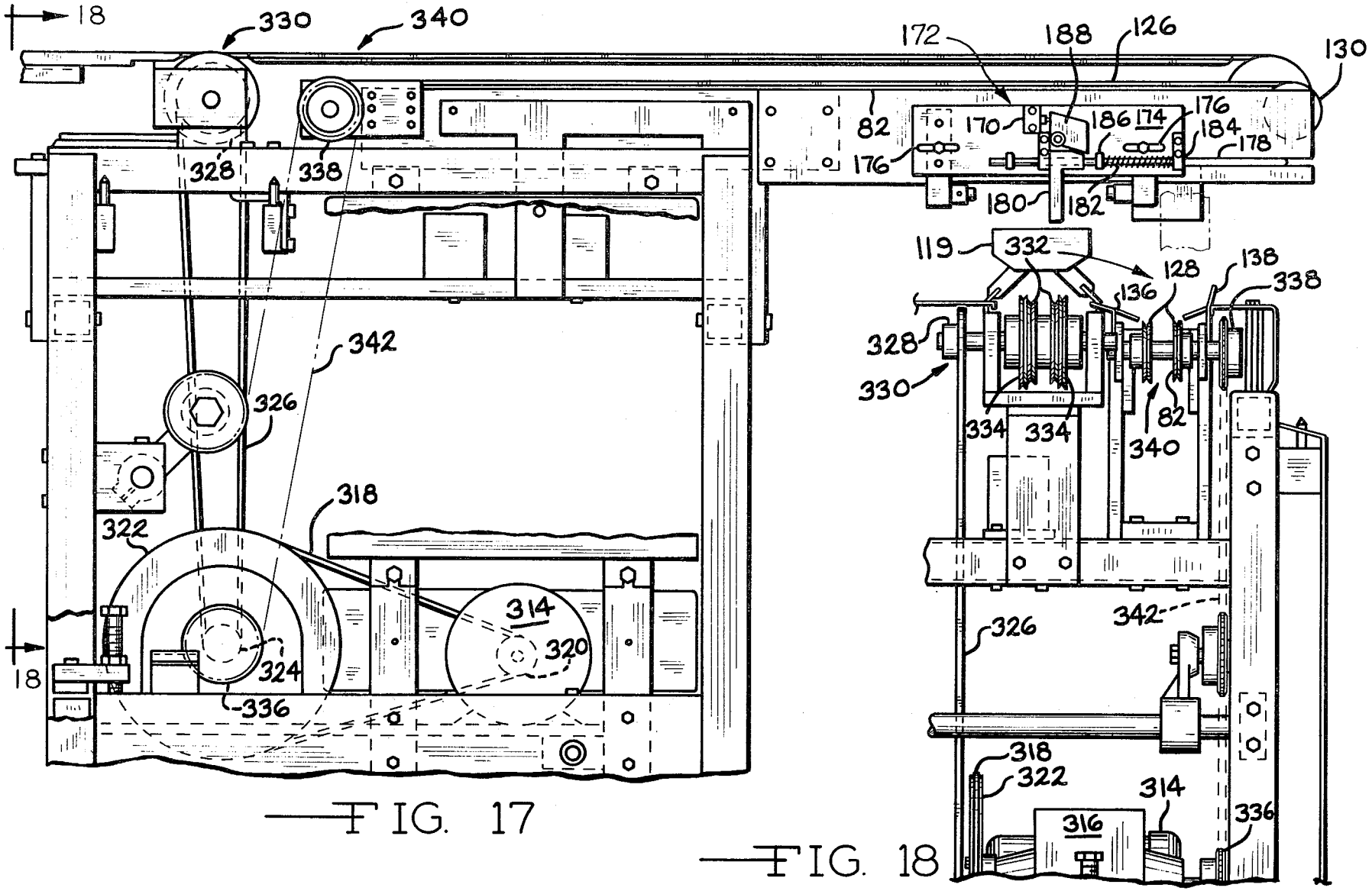
FIG. 17 is an enlarged elevational view of the lateral transfer portion of the conveyor.
FIG. 18 is a sectional view taken along lines 18—18 of FIG. 17.

In the dual lane embodiment, the other two sections of the delivery conveyor 68, namely, the intermediate section 71 and the end section 72, are both driven by a drive train shared with the bagger infeed conveyor 82. This drive train comprises an 1140 RPM motor unit 314 connected to the input shaft of an electrically activated clutch 316 by belt 318 and sheaves 320, 322. The sheaves 320, 322 are sized to provide a reduction of about 5–6:1. A driven sheave 324 also affixed to the clutch input shaft is connected by a belt 326 to sheave 328 keyed to the belt drive shaft assembly 330 for the delivery conveyor sections 71, 72. The sheaves 324, 328 are sized to provide a further reduction of 1.5–2:1. Drive shaft assembly 330 has both inner and outer pairs of sheaves 332, 334 keyed to the assembly shaft and is basically the same as the infeed belt drive assembly 42 shown in FIG. 10 except drive sprocket 199 is replaced by belt sheave 328, which is located on the opposite side of the assembly as can be seen in FIG. 18. The bagger infeed conveyor segment 82 is driven by a 20-tooth sprocket 336 affixed to the output shaft of clutch 316. It is connected to the 16-tooth drive sprocket 338 of the belt drive shaft assembly 340 by chain 342. Infeed drive belt sheaves 182 are approximately 60% smaller in diameter than delivery belt drove sheaves 332. 334 so the relative belt speed of the bagger infeed conveyor is about ten to 15 times less than that of the intermediate and end sections of the delivery conveyor.

When a dual lane system is adapted for use with a single bagging apparatus rather than two bagging devices, the stacks of cups 121 are transferred to a single bagger infeed conveyor 344 lying between the first sections of the dual delivery conveyors 68 as shown in FIG. 28. Each delivery section 70 is equipped with an offloading or lateral transfer device 74, 76 capable of offloading stacks of cups to either side as described hereinbefore with respect to lateral transfer devices 76 with double acting cylinders 120 shown in FIGS. 23–24A. The downstream components, including the bagging device, may be identical to the corresponding components previously described in conjunction with one lane of the dual lane system.

Figure 7A:
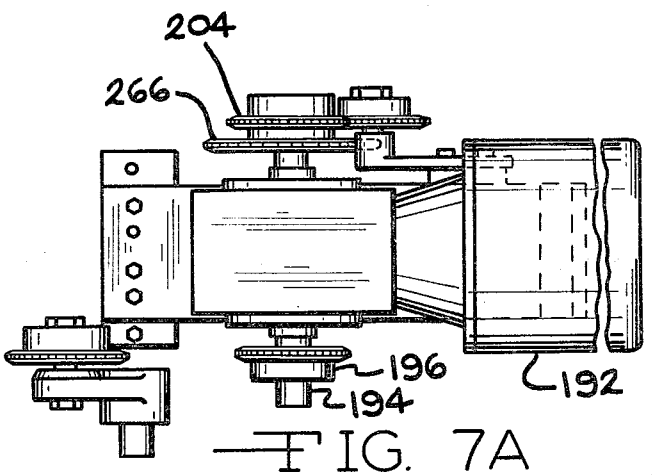
FIG. 7A is a plan view of the removed power unit taken along lines 7A—7A of FIG. 6 FIGS. 8, 8A and 8B are enlarged views partially in section taken along respective lines 8—8, 8A—8A and 8B—8B of FIG. 7 showing details of the three transmission shaft assemblies illustrated in full lines in FIG. 7 and used in the preferred embodiment.
Figure 7:
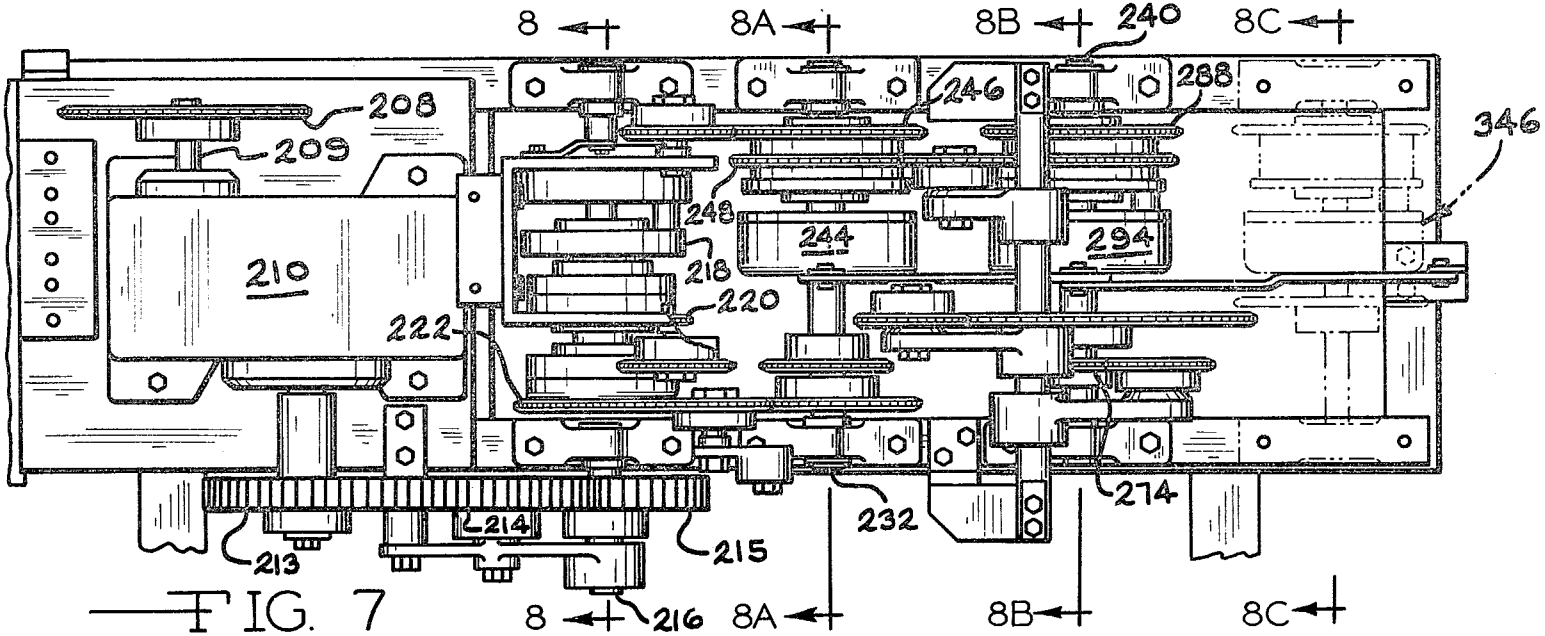
FIG. 7 is a plan view taken along lines 7—7 of FIG. 6 showing the main drive train with drive chains removed and with the power unit removed from the top thereof.

In the single bagger embodiment, the bagger infeed conveyor is driven by a transmission shaft incorporated into the main drive rather than by a separate drive system as used in the dual lane embodiment. Referring to FIG. 7A where the bagger infeed transmission shaft assembly 346 is shown in phantom lines and to the enlarged sectional view of FIG. 8C, the assembly comprises a 35-tooth sprocket 347 and the driven side of a clutch 348 keyed to transmission shaft 350. Another 35-tooth sprocket 352 and hub member 354 are rotatably mounted on the opposite end of transmission shaft 350 along with the driving side of clutch 348. Sprocket 352 is driven continuously at a constant speed by a chain (not shown) which connects it to the 35-tooth sprocket 288 on the verification transmission shaft in place of chain 296. The transmission shaft assembly 346 supplants the power unit of the separately powered bagger infeed drive train used in the dual bagger embodiment. Engagement of clutch 348 drives transmission sprocket 347 in the high-speed mode which in turn drives the single bagger infeed conveyor.

CUP COUNTING AND VERIFYING

Cups are counted while they are travelling in a spaced apart relationship on the conveyor system prior to their arrival on the nesting conveyor 46. Preferably the counter 355 is located at the beginning of the second section 40 of the infeed conveyor 36 and comprises a photoelectric eye 356 mounted in a confronting relationship to a light source 358 located on the opposite side of the infeed conveyor and directing a light beam towards the photoelectric eye 356. Cups are counted as the light beam is remade after being broken by a passing cup. In the disclosed embodiment the cup counter has two separate set points. The initial set point closes a relay after a selected number of cups for example after two to five cups have passed the counter. The final set point closes another relay after the selected batch count or total count for a stack has been reached.

Figure 5:
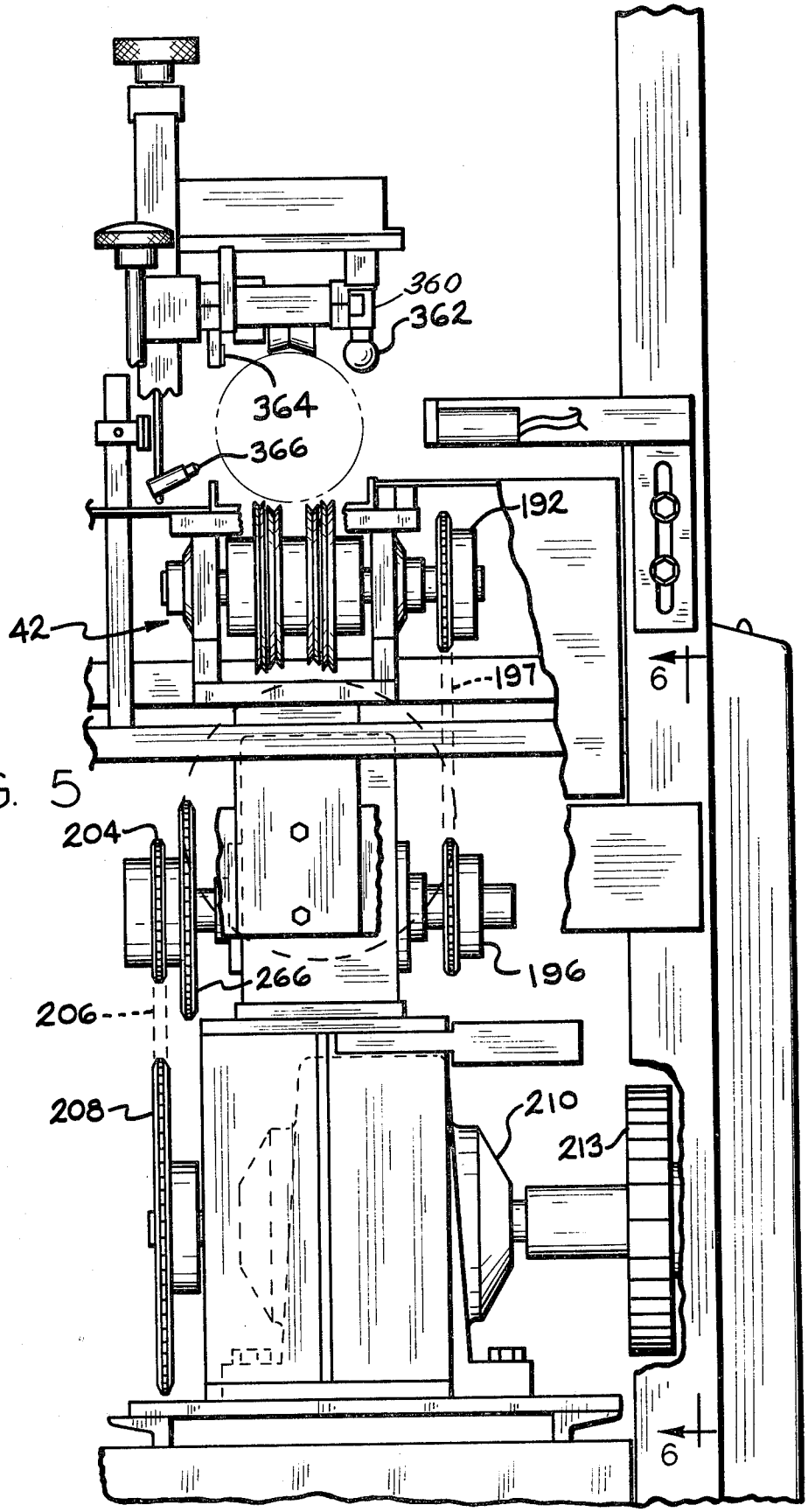
FIG. 5 is a further enlarged sectional view taken along lines 5—5 of FIG. 1 with parts broken away.
Figure 6:
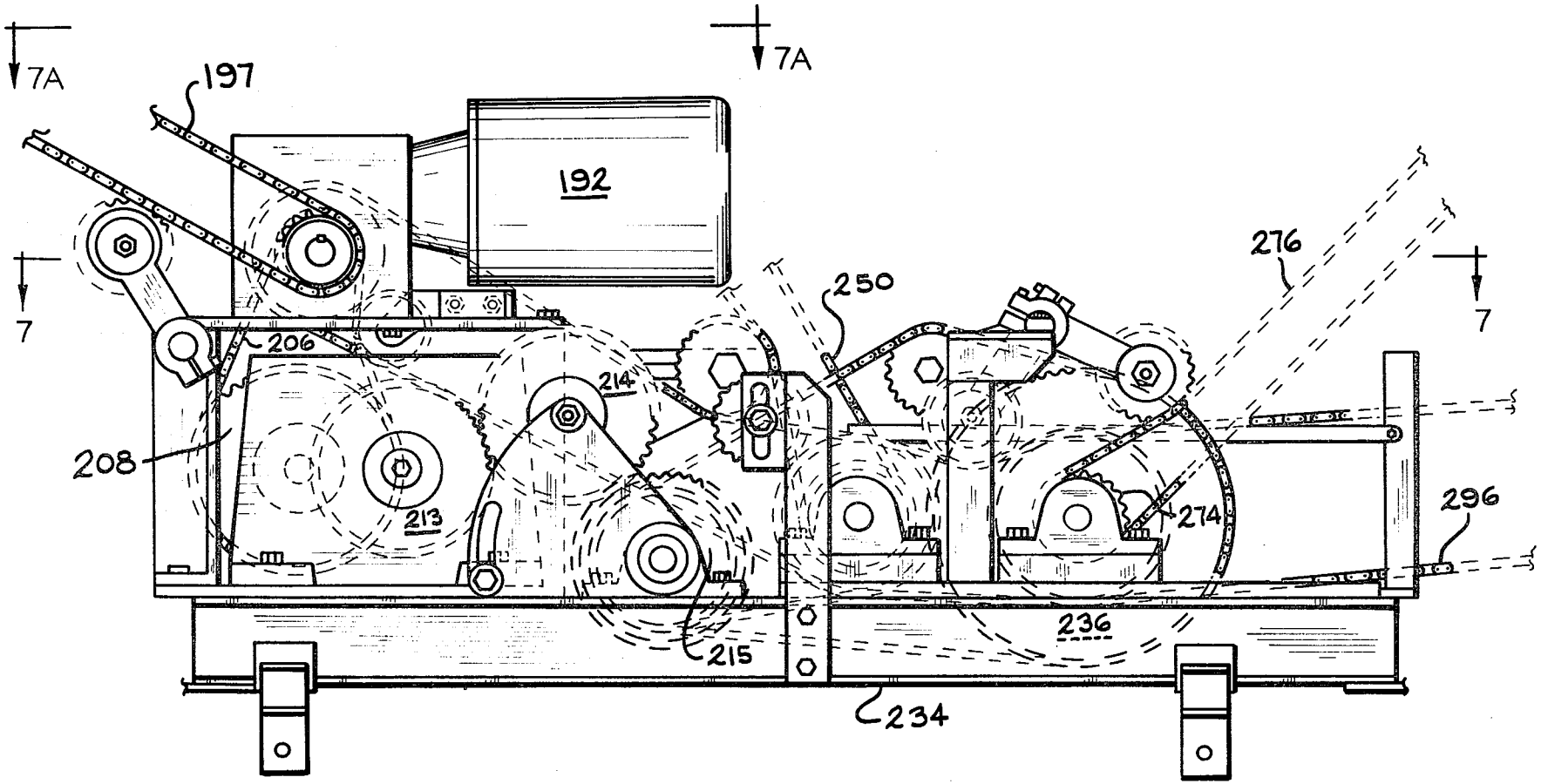
FIG. 6 is a side view taken along lines 6—6 of FIG. 5 showing the main drive train of the conveyor.
Figure 9:
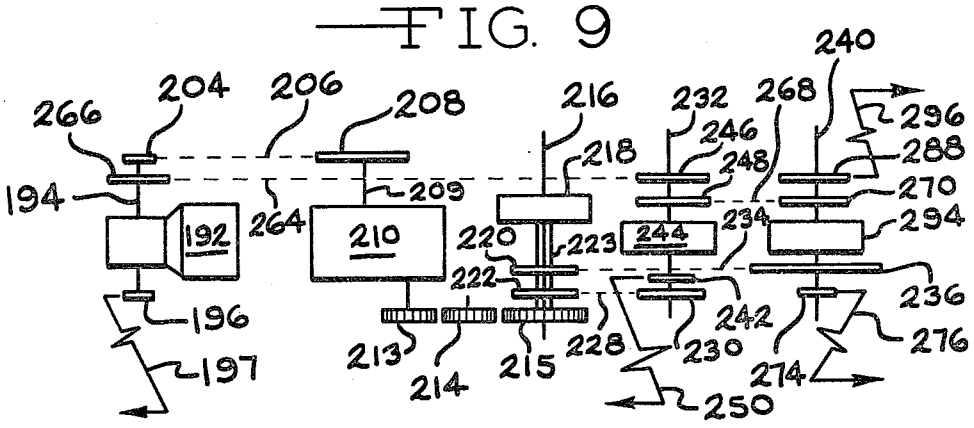
FIG. 9 is a plan view in schematic form of the drive train of FIG. 7 showing the interconnection between power unit and the various transmission shafts.
Figure 26:
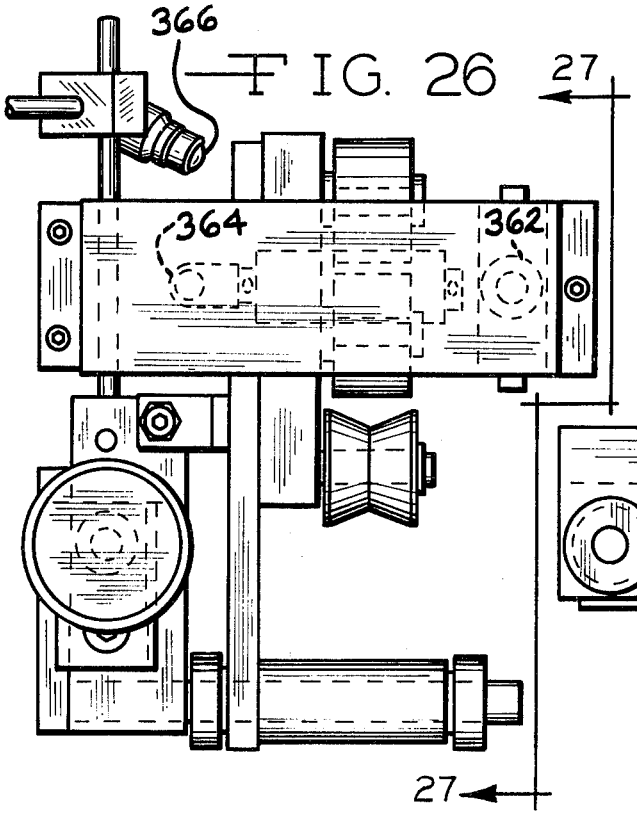
FIG. 26 is an enlarged plan view showing the batch count verification means along with its mounting members and associated conveyor components.
Figure 27:
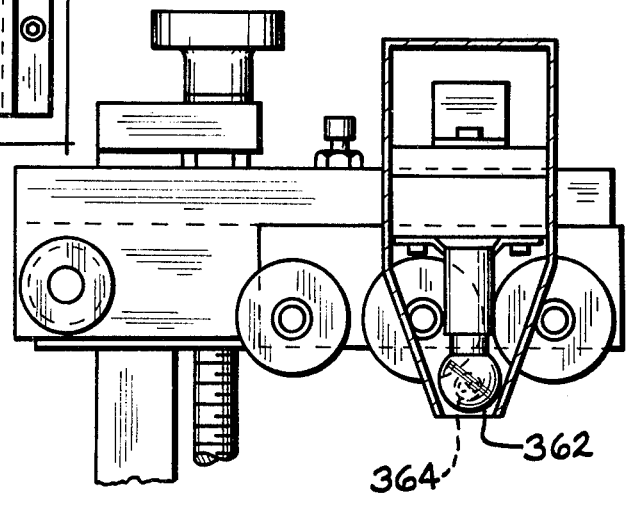
FIG. 27 is a side view of a portion of the verification means taken along lines 27—27 of FIG. 26.

A count verifying device 360 located downstream from the counter 355, preferably adjacent the downstream end of the verification conveyor segment 66, has a light beam source 362 which directs a beam of light across the top of a stack of cups from the outside of the conveyor such that the rims of the nested cups and the spaces between the rims respectively break and remake the light beam aimed towards a photoelectric eye 364 positioned at the same elevation on the opposite side of the conveyor (see FIGS. 5, 26 and 27). This is done as a stack of cups is conveyed to the delivery conveyor. If the verified count does not match the total count, the offloading device 74 is actuated by a signal from the verifying device 360 and the cups are tilted off the right side of the first delivery section 70 into a holding tray 78, 80. A second photoelectric eye 366 is located below the level of the first photoelectric eye 364 and directed at the same light source 362. This second photoelectric eye 366 designated as the arming photohead is set at a position and angle that will cause it to detect the leading end of an entering stack of cups. When the light beam to the arming photohead 366 is broken, the previous count remaining in the verification device is cleared and it is reset to zero. The new stack of cups is counted by the number of shadows produced as the rims break the light beam to photoelectric eye 364, while the beam to the arming photohead 366 remains broken by the body of a stack of cups.

OPERATION AND CONTROL

When the machine is turned on, the main drive motor 192 runs continuously and rotates the drive components of both the infeed conveyor 36 and the first delivery conveyor section 70 as well as the slow-speed transmission shaft 216. Initially, all of the clutches 218, 244, 294 of the main drive are disengaged. Preferably a programmable controller 370 is used to automatically control the timing and sequencing of the various activating mechanisms. After a first preset number of cups, for example three or four, have passed counter 355, a relay is closed so as to energize clutch 218 on the slow-speed shaft 216 causing the nesting and verification conveyors 46, 66 to be driven in the slow-speed mode. The counter 355 may be provided with a means for producing a signal to disengage the slow-speed clutch 218 in the event the supply of incoming cups passing the counter is interrupted for a time interval that exceeds the usual time interval between cups. Counting is resumed and the slow-speed clutch 218 is reengaged when the next cup arrives at the counter. Counting continues until the total count of counter 355 equals the second preset number or batch count at which time relays are closed so as to energize the nesting or fast-speed transmission clutch 244 and the verification transmission clutch 294, thus shifting the nesting and verification conveyors 46, 66 into their high-speed mode to rapidly convey a nested batch or stack of cups 121 off of the nesting and verification conveyors onto the succeeding delivery conveyor 68. Simultaneously the slow-speed transmission clutch may be disengaged. During the time either or both the nesting clutch 244 and verification clutch 294 are engaged and their respective conveyors are operating in the high-speed mode, the roller ramp clutches of their respective slow-speed drive sprockets 220, 222 on the slow-speed transmission shaft 216 are overridden.

The nesting conveyor clutch 244 is engaged for only a short time period of sufficient length to permit all of the cups in the counted stack to clear the nesting conveyor 66. A timer which starts to run when the clutch 244 is engaged is set to open the nesting clutch relay and allow the nesting conveyor to be stopped prior to the arrival on the nesting conveyor of the first cup of the next stack. Again after the first preset number of cups of the next stack, for example three or four cups, has passed the counter 355, the slow-speed clutch 218 is engaged to drive the nesting conveyor in the slow-speed mode and the cycle is repeated.

Figure 4:
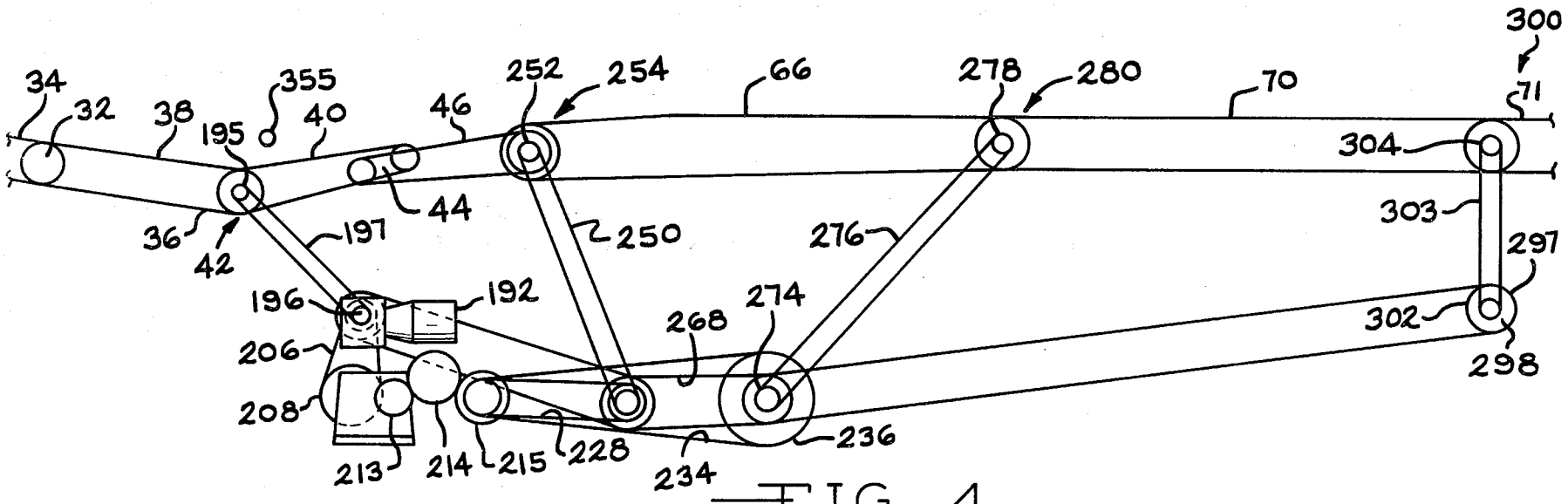
FIG. 4 is a schematic type elevational view of the drive train for the conveyor portion illustrated in FIG. 3.
Figure 4A:
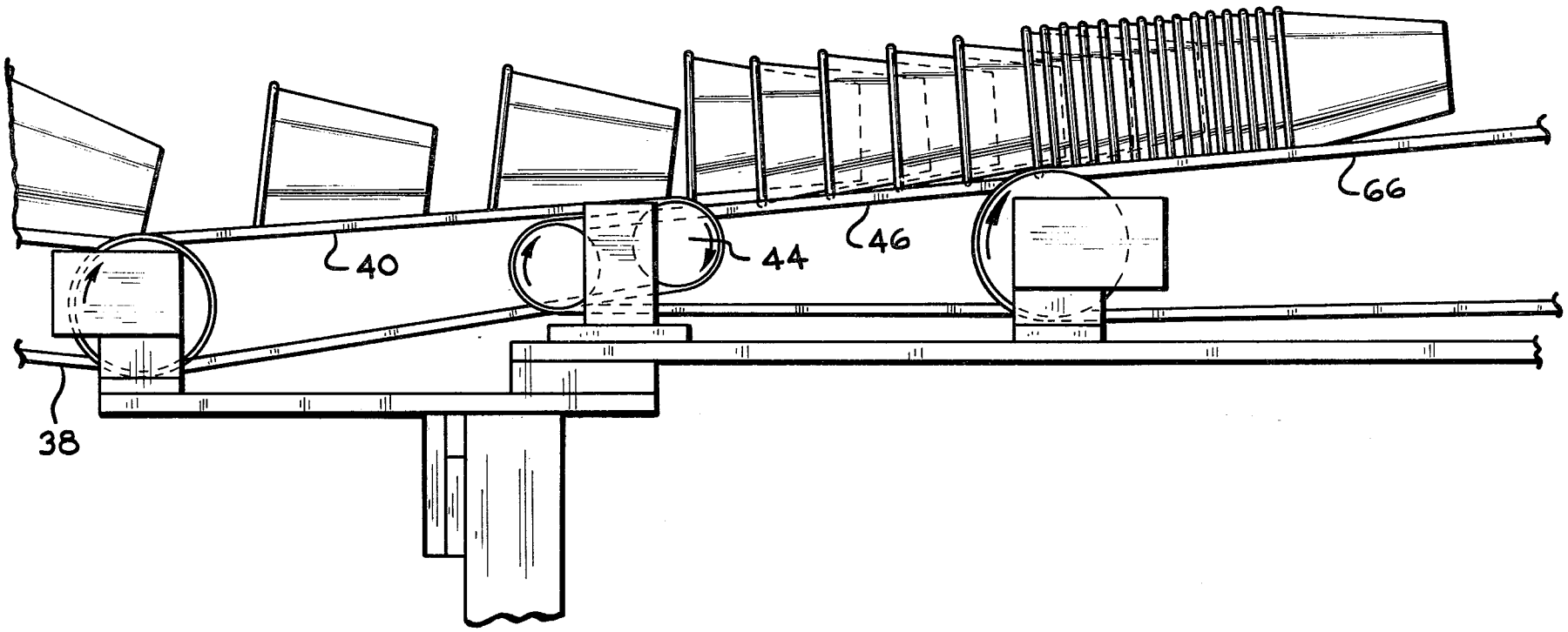
FIG. 4A is an enlarged view of the infeed and nesting portion of the conveyor showing how the cups are nested.

The nesting operation can be understood best if reference is made to FIG. 4A where cups are in a spaced-apart relationship on the infeed conveyor sections 38, 40, in a loosely nested relationship on the nesting conveyor 46 and in a tightly nested relationship on the verification conveyor 66. The reduction of spacing is achieved by running the separate conveyor segments at reduced speeds. Preferably the nesting conveyor is operated at a travel speed about one-quarter that of the infeed conveyor section 40. Likewise verification conveyor segment 66 is operated at a travel speed of one-quarter that of the nesting conveyor. It should be noted that the cup bottoms rest on the respective infeed and nesting conveyors where the cups are either spaced from one another or loosely nested together. When the cups are tightly nested together, their bottoms are elevated from the conveyor and the frustoconical cups are coaxially aligned in a column or stack.

This invention has been described and illustrated with respect to a preferred embodiment but it is to be understood that numerous modifications may be made without departing from the true scope of the invention.

I claim:

1. A cup-nesting apparatus comprising a series of directionally aligned conveyors including first, second and third conveyors, said conveyors being of the twin belt type with adjacent ends interjoined with one another such that at least one pair of belt ends is disposed inside the adjoining ends of a downstream conveyor, a vertical offset between adjacent ends of said first and second conveyors and means for driving said conveyors at different speeds relative to one another, said driving means including shiftable transmission assemblies having output speed ratios such that during at least a portion of a cycle the relative travel speed of said first conveyor is greater than that of said second conveyor, and the relative speed of said second conveyor is greater than said third conveyor so as to loosely nest a plurality of cups on said second conveyor and more tightly nest said cups on said third conveyor.

2. A cup-nesting apparatus according to claim 1 wherein said shiftable transmission assemblies also have output speed ratios such that during another portion of a cycle the relative travel speeds of said second and third conveyors are greater than that of said first conveyor.

3. A cup-nesting apparatus according to claim 1 wherein the relative speeds of said second and third conveyors have a ratio of about 4:1.

4. A cup-nesting apparatus according to claim 1 wherein the relative speeds of said first and second conveyors have a ratio of about 4:1.

5. A cup-nesting apparatus according to claim 1 further including a means for adjusting the amount of offset between said first and second conveyors.

6. A cup-nesting apparatus according to claim 1 further including a counting device associated with said first conveyor, said counting device having a partial count set point and a total count set point.

7. A cup-nesting apparatus according to claim 1 further including a fourth conveyor at the end of said third conveyor and a means for laterally offloading nested cups from said fourth conveyor.

8. A cup-nesting apparatus comprising a series of interjoined conveyors including a first conveyor, a second conveyor, a third conveyor, and a fourth conveyor at the end of said third conveyor, said conveyors being disposed in directional alignment with one another, a vertical offset between adjacent ends of said first and second conveyors, each of said conveyors being a dual-lane conveyor, a single-lane fifth conveyor located between the dual lanes of said fourth conveyor, a lateral transfer device associated with each lane of said fourth conveyor for transferring nested cups to said fifth conveyor and means for driving said conveyors at different speeds relative to one another.

9. A cup-nesting apparatus according to claim 8 wherein said lateral transfer devices are activated by a double-acting mechanism so as to be capable of transferring nested cups to the outside of each lane of said fourth conveyor as well as to the inside thereof.

10. A cup-nesting apparatus according to claim 8 further including a bagging device aligned with said fifth conveyor for encapsulating groups of nested cups in a plastic overwrap.

11. A cup-nesting apparatus comprising a series of interjoined twin continuous belt conveyors including a first conveyor, a second conveyor and a third conveyor, said conveyors being in directional alignment with one another, a vertical offset between adjacent ends of said first and second conveyors, a mechanism for adjusting the amount of said offset, said adjusting mechanism comprising a rocker arm assembly pivotally mounted intermediate its ends, an outer pair of belt sheaves rotatably mounted on one end of said arm assembly carrying the upstream ends of the twin belts of said second conveyor, an inner pair of belt sheaves rotatably mounted on the other end of said arm assembly carrying the downstream ends of said first conveyor, a threaded means connected to one end of said rocker arm assembly to position one end of the rocker arm assembly at the desired elevation while correspondingly moving the other end in an opposite direction and a counting device associated with said first conveyor, means for driving said conveyors at different relative travel speeds and cycling the travel speeds of said second and third conveyors in response to a control signal emanating from said counting device.

12. A cup-nesting apparatus comprising a series of interjoined twin continuous belt conveyors including a first conveyor, a second conveyor, a third conveyor, said conveyors being in directional alignment with one another, a vertical offset between adjacent ends of said first and second conveyors, a fourth conveyor at the end of said third conveyor and aligned therewith, means for offloading nested cups from said fourth conveyor, a counter associated with said first conveyor, means for driving said conveyors at different relative travel speeds and cycling the travel speeds of said second and third conveyors in response to a control signal emanating from said counting device and a verifying counter device associated with said third conveyor, said offloading device being triggered by a signal which emanates from said verifying counter in the event the verified count does not match the count of the prior counting device.

13. A cup-nesting apparatus according to claim 12 wherein the combination further includes a fifth conveyor directionally aligned with the downstream end of said fourth conveyor, a sixth conveyor paralleling and alongside said fifth conveyor with its top run at a level below that of said fifth conveyor, a lateral transfer device associated with said fifth conveyor for offloading nested cups from said fifth conveyor to said sixth conveyor and a bagging device for receiving nested cups from said sixth conveyor and sealing said nested cups in a plastic overwrap.

14. A cup-nesting apparatus according to claim 13 further including a collection bin for accumulating a plurality of overwrapped cups and an upwardly inclined conveyor ramp leading from said bagging device to the top of said collection bin.

15. A cup-nesting apparatus according to claim 14 wherein each of said conveyors is a dual-lane conveyor and each lane has a bagging device.

16. A cup-nesting apparatus comprising a series of interjoined twin continuous belt conveyors including a first conveyor, a second conveyor, a third conveyor said conveyors being in directional alignment with one another, vertical offset between adjacent ends of said first and second conveyors, a fourth conveyor at the end of said third conveyor and aligned therewith, each of said conveyors being a dual lane cnveyor the combination further including a single-lane fifth conveyor lying between the lanes of said fourth conveyor at a lower level, means for offloading nested cups from said fourth conveyor, said offloading device for each lane of said fourth conveyor having a double-acting fluid cylinder such that nested cups can be offloaded to either side of each lane of said fourth conveyor, a counter associated with said first conveyor and means for driving said conveyors at different relative travel speeds and cycling the travel speeds of said second and third conveyors in response to a control signal emanating from said counting device.

17. A cup-nesting apparatus according to claim 16 further including a bagging device aligned with said fifth conveyor for encapsulating a group of nested cups in a plastic overwrap.

18. A cup-nesting apparatus comprising a series of interjoined twin continuous belt conveyors including a first conveyor, a second conveyor, a third conveyor, a fourth conveyor, a fifth conveyor, said conveyors being in directional alignment with one another, a vertical offset between said first and second conveyors, means for adjusting the relative amount of said offset, a counting device associated with said first conveyor, a count-verifying device associated with said third conveyor, an offloading device associated with said fourth conveyor, a tray for holding nested cups offloaded from said fourth conveyor, a lateral transfer device associated with said fifth conveyor, a sixth conveyor paralleling and alongside said fifth conveyor with its top run at a level below that of said fifth conveyor for receiving nested cups transferred from said fifth conveyor, a bagging device for sealing a plurality of nested cups in a plastic overwrap, a collection bin for accumulating stacks of nested overwrapped cups, an upwardly inclined conveyor ramp extending between said bagging device and said collection bin and a means for driving said conveyors, said means including transmission means for cyclically driving said second and third conveyors such that at one portion of a cycle said second conveyor has a travel speed that is less than said first conveyor but greater than said third conveyor and for another portion of the cycle both of said second and third conveyors have a travel speed that is greater than said first conveyor.

* * * * *